US008494423B2

(12) United States Patent
Soeda

(10) Patent No.: US 8,494,423 B2
(45) Date of Patent: Jul. 23, 2013

(54) FUSER DEVICE HAVING SEPARATOR WITH INCLINED SURFACE, AND IMAGE FORMING DEVICE

(75) Inventor: Teruo Soeda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 278 days.

(21) Appl. No.: 13/008,223

(22) Filed: Jan. 18, 2011

(65) Prior Publication Data

US 2011/0182631 A1 Jul. 28, 2011

(30) Foreign Application Priority Data

Jan. 26, 2010 (JP) ..... 2010-013991

(51) Int. Cl.
*G03G 15/20* (2006.01)

(52) U.S. Cl.
USPC ..... 399/323

(58) Field of Classification Search
USPC ..... 399/323, 398–399
See application file for complete search history.

(56) References Cited

U.S. PATENT DOCUMENTS

| | | | | |
|---|---|---|---|---|
| 3,938,950 | A * | 2/1976 | Weiler et al. | 432/59 |
| 5,138,381 | A * | 8/1992 | Masaki et al. | 399/159 |
| 5,518,781 | A * | 5/1996 | Nakamura et al. | 524/497 |
| 5,600,428 | A * | 2/1997 | Yanagida | 399/399 |
| 6,029,038 | A * | 2/2000 | Uehara et al. | 399/323 |
| 6,839,537 | B2 * | 1/2005 | Mouri et al. | 399/323 |
| 2001/0016134 | A1 * | 8/2001 | Park | 399/397 |
| 2008/0253790 | A1 * | 10/2008 | Tateishi et al. | 399/70 |
| 2009/0003897 | A1 * | 1/2009 | Yamada | 399/323 |
| 2010/0215413 | A1 * | 8/2010 | Nakajima | 399/323 |

FOREIGN PATENT DOCUMENTS

| | | | |
|---|---|---|---|
| JP | A-H06-149114 | | 5/1994 |
| JP | A-2005-037567 | | 2/2005 |
| JP | 2006313280 | A * | 11/2006 |
| JP | A-2008-139445 | | 6/2008 |

* cited by examiner

*Primary Examiner* — G. M. Hyder
(74) *Attorney, Agent, or Firm* — Posz Law Group, PLC

(57) ABSTRACT

A fuser device includes: a fuser member that heats developer on a print medium; a pressure member that presses the fuser member so as to provide a contact region therebetween; and a separation member that separates the print medium, which is ejected from the contact region, from either the fuser member or the pressure member. The separation member includes a separator in a plate-like shape and a support member that supports the separator such that the separator is disposed in the vicinity of the fuser member. The separator includes a planar part in a plate-like shape that is sustained by the support member; a tip part that is a tip of the separator, an inclined surface part that is inclined toward the tip part in a thickness direction of the separator, a border part that is defined as a boundary between the planar part and the inclined surface part.

18 Claims, 18 Drawing Sheets

| Bend Amount ΔB [mm] | Tip Part Gap Δε [mm] | Angle γ [deg] | Angle η [deg] | Drop Experiment (Height: 1.0 m) | Separation Experiment | | Compre-hensive Evaluation |
|---|---|---|---|---|---|---|---|
| | | | | | Developer (100%) | Developer (270%) | |
| 0 | 0.15 | 180 | 85.2 | × | ○ | ○ | × |
| 0.05 | 0.20 | 177 | 88.2 | × | ○ | ○ | × |
| 0.1 | 0.25 | 174 | 91.2 | × | ○ | ○ | × |
| 0.2 | 0.35 | 169 | 96.2 | × | ○ | ○ | × |
| 0.3 | 0.45 | 163 | 102.2 | × | ○ | ○ | × |
| 0.4 | 0.55 | 158 | 107.2 | × | ○ | ○ | × |

Δα = 0.2 [mm]
ζ = 94.8 [deg]

Fig. 10

| Bend Amount ΔB [mm] | Tip Part Gap Δε [mm] | Angle γ [deg] | Angle η [deg] | Drop Experiment (Height: 1.0 m) | Separation Experiment | | Compre-hensive Evaluation |
|---|---|---|---|---|---|---|---|
| | | | | | Developer (100%) | Developer (270%) | |
| 0 | 0.25 | 180 | 85.2 | × | ○ | ○ | × |
| 0.05 | 0.30 | 177 | 88.2 | Δ | ○ | ○ | ○ |
| 0.1 | 0.35 | 174 | 91.2 | Δ | ○ | ○ | ○ |
| 0.2 | 0.45 | 169 | 96.2 | Δ | ○ | ○ | ○ |
| 0.3 | 0.55 | 163 | 102.2 | Δ | ○ | ○ | ○ |
| 0.4 | 0.65 | 158 | 107.2 | Δ | ○ | ○ | ○ |

Δα = 0.3 [mm]
ζ = 94.8 [deg]

Fig. 11

| Bend Amount ΔB [mm] | Tip Part Gap Δε [mm] | Angle γ [deg] | Angle η [deg] | Drop Experiment (Height: 1.0 m) | Separation Experiment | | Compre-hensive Evaluation |
|---|---|---|---|---|---|---|---|
| | | | | | Developer (100%) | Developer (270%) | |
| 0 | 0.25 | 180 | 85.2 | × | ○ | ○ | × |
| 0.05 | 0.30 | 177 | 88.2 | Δ | ○ | ○ | ○ |
| 0.1 | 0.35 | 174 | 91.2 | Δ | ○ | ○ | ○ |
| 0.2 | 0.45 | 169 | 96.2 | Δ | ○ | ○ | ○ |
| 0.3 | 0.55 | 163 | 102.2 | Δ | ○ | ○ | ○ |
| 0.4 | 0.65 | 158 | 107.2 | Δ | ○ | ○ | ○ |

Δα = 0.4 [mm]
ζ = 94.8 [deg]

Fig. 12

| Bend Amount ΔB [mm] | Tip Part Gap Δε [mm] | Angle γ [deg] | Angle η [deg] | Drop Experiment (Height: 1.0 m) | Separation Experiment | | Compre-hensive Evaluation |
|---|---|---|---|---|---|---|---|
| | | | | | Developer (100%) | Developer (270%) | |
| 0 | 0.55 | 180 | 85.2 | × | ○ | ○ | × |
| 0.05 | 0.60 | 177 | 88.2 | ○ | ○ | ○ | ◎ |
| 0.1 | 0.65 | 174 | 91.2 | ○ | ○ | ○ | ◎ |
| 0.2 | 0.75 | 169 | 96.2 | ○ | ○ | ○ | ◎ |
| 0.3 | 0.85 | 163 | 102.2 | ○ | ○ | × | ○ |
| 0.4 | 0.95 | 158 | 107.2 | ○ | ○ | × | ○ |

Δα = 0.6 [mm]
ζ = 94.8 [deg]

Fig. 13

| Bend Amount $\Delta B$ [mm] | Tip Part Gap $\Delta \varepsilon$ [mm] | Angle $\gamma$ [deg] | Angle $\eta$ [deg] | Drop Experiment (Height: 1.0 m) | Separation Experiment | | Comprehensive Evaluation |
|---|---|---|---|---|---|---|---|
| | | | | | Developer (100%) | Developer (270%) | |
| 0 | 0.95 | 180 | 85.2 | × | ○ | × | × |
| 0.05 | 1.00 | 177 | 88.2 | ○ | ○ | × | ○ |
| 0.1 | 1.05 | 174 | 91.2 | ○ | ○ | × | ○ |
| 0.2 | 1.15 | 169 | 96.2 | ○ | ○ | × | ○ |
| 0.3 | 1.25 | 163 | 102.2 | ○ | × | × | × |
| 0.4 | 1.35 | 158 | 107.2 | ○ | × | × | × |

$\Delta \alpha$ = 1.0 [mm]
$\zeta$ = 94.8 [deg]

Fig. 14

| Bend Amount $\Delta B$ [mm] | Tip Part Gap $\Delta \varepsilon$ [mm] | Angle $\gamma$ [deg] | Angle $\eta$ [deg] | Drop Experiment (Height: 1.0 m) | Separation Experiment | | Comprehensive Evaluation |
|---|---|---|---|---|---|---|---|
| | | | | | Developer (100%) | Developer (270%) | |
| 0 | 0.95 | 180 | 85.2 | × | ○ | × | × |
| 0.05 | 1.00 | 177 | 88.2 | ○ | ○ | × | ○ |
| 0.1 | 1.05 | 174 | 91.2 | ○ | ○ | × | ○ |
| 0.2 | 1.15 | 169 | 96.2 | ○ | ○ | × | ○ |
| 0.3 | 1.25 | 163 | 102.2 | ○ | × | × | × |
| 0.4 | 1.35 | 158 | 107.2 | ○ | × | × | × |

$\Delta \alpha$ = 1.5 [mm]
$\zeta$ = 94.8 [deg]

Fig. 15

| Bend Amount $\Delta B$ [mm] | Tip Part Gap $\Delta \varepsilon$ [mm] | Angle $\gamma$ [deg] | Angle $\eta$ [deg] | Drop Experiment (Height: 1.0 m) | Separation Experiment | | Comprehensive Evaluation |
|---|---|---|---|---|---|---|---|
| | | | | | Developer (100%) | Developer (270%) | |
| 0 | 1.95 | 180 | 85.2 | ○ | × | × | × |
| 0.05 | 2.00 | 177 | 88.2 | ○ | × | × | × |
| 0.1 | 2.05 | 174 | 91.2 | ○ | × | × | × |
| 0.2 | 2.15 | 169 | 96.2 | ○ | × | × | × |
| 0.3 | 2.25 | 163 | 102.2 | ○ | × | × | × |
| 0.4 | 2.35 | 158 | 107.2 | ○ | × | × | × |

$\Delta \alpha$ = 2.0 [mm]
$\zeta$ = 94.8 [deg]

Fig. 16

| Δ α [mm] | Δ ε [mm] | Comprehensive Determination |
|---|---|---|
| 0.3 | 0.25 | × |
| 0.3 | 0.30 | ○ |
| 0.3 | 0.35 | ○ |
| 0.4 | 0.35 | × |
| 0.4 | 0.40 | ◎ |
| 0.3 | 0.45 | ○ |
| 0.4 | 0.45 | ◎ |
| 0.3 | 0.55 | ○ |
| 0.4 | 0.55 | ◎ |
| 0.6 | 0.55 | × |
| 0.6 | 0.60 | ◎ |
| 0.3 | 0.65 | ○ |
| 0.4 | 0.65 | ◎ |
| 0.6 | 0.65 | ◎ |
| 0.4 | 0.75 | ◎ |
| 0.6 | 0.75 | ◎ |
| 0.6 | 0.85 | ○ |
| 0.6 | 0.95 | ○ |
| 1.0 | 0.95 | × |
| 1.0 | 1.00 | ○ |
| 1.0 | 1.05 | ○ |
| 1.0 | 1.15 | ○ |
| 1.0 | 1.25 | × |
| 1.0 | 1.35 | × |

Fig. 17

FUSER DEVICE HAVING SEPARATOR WITH INCLINED SURFACE, AND IMAGE FORMING DEVICE

CROSS REFERENCE

The present application is related to, claims priority from and incorporates by reference Japanese patent application number 2010-013991, filed on Jan. 26, 2010.

TECHNICAL FIELD

The present invention relates to a fuser device and an image forming device that uses the fuser device.

BACKGROUND

In a conventional fuser device and image forming device that uses the fuser device, a technology in which a medium is reliably separated is known. It is performed through adjusting a gap between a center part of a separation member and a fuser member by contacting a spacer that is provided at both edges of the separation member to the fuser member.

Even though a diameter of a roller is changed due to thermal expansion, a technology in which a gap between a separation member and the roller is kept constant is disclosed in Japanese laid-open patent application publication number 2005-37567.

However, a fuser member or a pressure member may be damaged during their transportation or when they are dropped. In such a case, print image quality deterioration might occur.

SUMMARY

An object of embodiments according to the present invention is to increase image quality.

A fuser device disclosed in the present application includes: a fuser member that heats developer on a print medium; a pressure member that presses the fuser member so as to provide a contact region therebetween; and a separation member that separates the print medium, which is ejected from the contact region, from either the fuser member or the pressure member. The separation member includes a separator in a plate-like shape and a support member that supports the separator such that the separator is disposed in the vicinity of the fuser member. The separator includes a planar part in a plate-like shape that is sustained by the support member; a tip part that is a tip of the separator, an inclined surface part that is inclined toward the tip part in a thickness direction of the separator, a border part that is defined as a boundary between the planar part and the inclined surface part.

One feature of an image forming device according to the present invention is to have the above fuser device.

With embodiments disclosed in the application, the image quality increases.

BRIEF DESCRIPTION OF THE DRAWINGS

FIG. 10 is a chart for results of drop and sheet separation experiments with a condition in which a gap distance ($\Delta\alpha$) is equal to 0.2 mm ($\Delta\alpha$=0.2 mm).

FIG. 11 is a chart for results of drop and sheet separation experiments with a condition in which $\Delta\alpha$ is equal to 0.3 mm ($\Delta\alpha$=0.3 mm).

FIG. 12 is a chart for results of drop and sheet separation experiments with a condition in which $\Delta\alpha$ is equal to 0.4 mm ($\Delta\alpha$=0.4 mm).

FIG. 13 is a chart for results of drop and sheet separation experiments with a condition in which $\Delta\alpha$ is equal to 0.6 mm ($\Delta\alpha$=0.6 mm).

FIG. 14 is a chart for results of drop and sheet separation experiments with a condition in which $\Delta\alpha$ is equal to 1.0 mm ($\Delta\alpha$=1.0 mm).

FIG. 15 is a chart for results of drop and sheet separation experiments with a condition in which $\Delta\alpha$ is equal to 1.5 mm ($\Delta\alpha$=1.5 mm).

FIG. 16 is a chart for results of drop and sheet separation experiments with a condition in which $\Delta\alpha$ is equal to 2.0 mm ($\Delta\alpha$=2.0 mm).

FIG. 17 is a chart for comprehensive determination of drop and sheet separation experiments.

DETAILED DESCRIPTION

Embodiments according to the present invention become apparent by reading the following preferred embodiments with reference to drawings. However, because the drawings are provided for explanation purposes, the drawings do not limit the scope of the present invention.

First Embodiment

Configuration of First Embodiment

Figure 2:
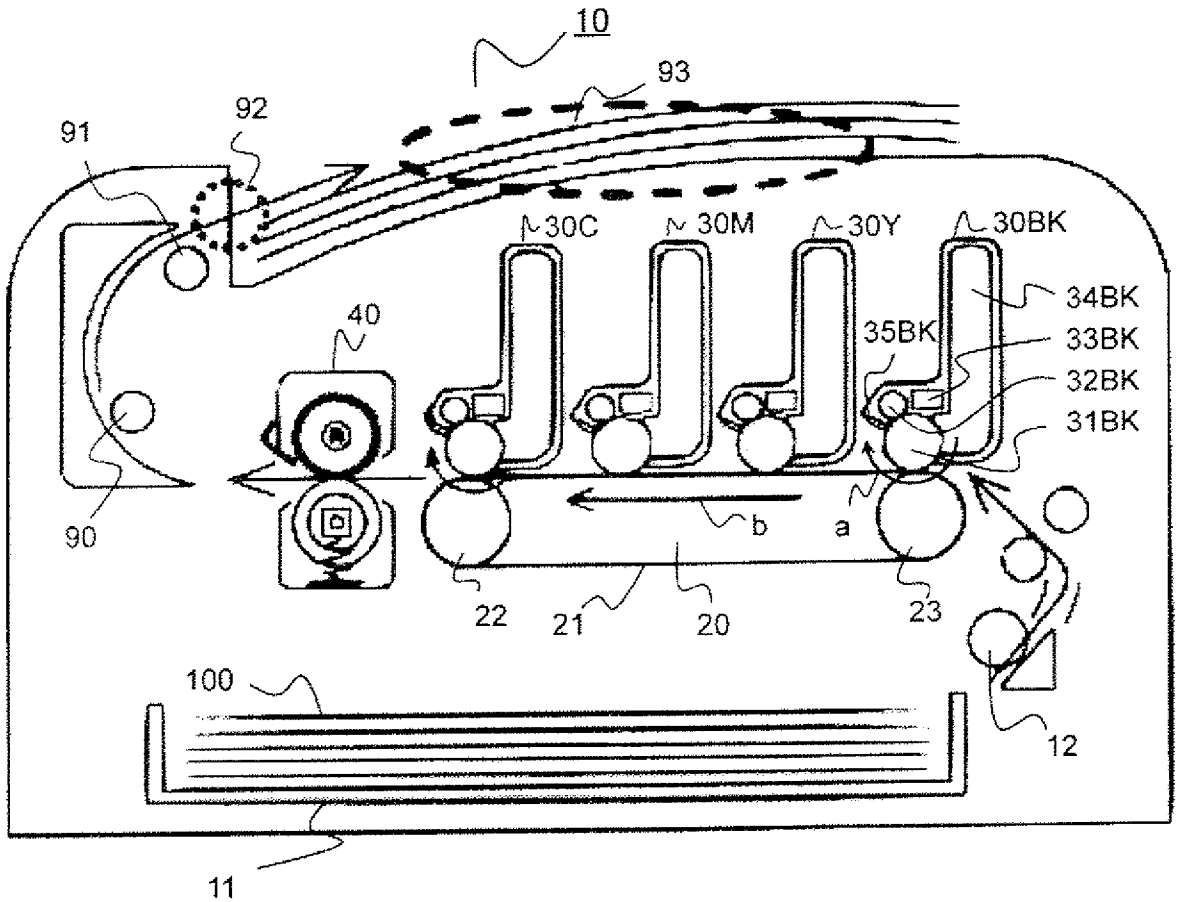
FIG. 2 is a schematic view of an image forming device in which a fuser device of the first embodiment is assembled.

FIG. 2 a schematic view of an image forming device in which a fuser device of a first embodiment is assembled.

An image forming device 10 is, for example, a color image print device. The image forming device 10 is configured with a sheet feeding cassette 11 that stores a print medium 100, a registration roller 12 that supplies the print medium 100 in response to timing of an image forming, image forming devices 30BK (black), 30Y (yellow), 30M (magenta) and 30C (cyan) that form an image on the print medium 100 corresponding to each color, a belt-type transferring device 20 that is provided opposite to the image forming devices 30BK, 30Y, 30M and 30C, a fuser device 40 that fuses a developer image formed on the print medium 100, rollers 90 and 91 that carry the print medium 100 on which the developer image is fused, an ejecting part 92 that ejects the print medium 100, and a print medium stack part 93 that stacks the ejected print medium 100.

The print medium 100 is a medium on which a developer image is formed and is stored in the sheet feeding cassette 11. The registration roller 12 sends the print medium 100 that is stored in the sheet feeding cassette 11 one sheet at a time toward the image forming devices 30BK, 30Y, 30M and 30C.

The image forming devices 30BK, 30Y, 30M and 30C are serially located along a carrying path for the print medium 100 and form toner images on the print medium 100 with each of four colors in black, yellow, magenta and cyan. Since configurations of the image forming devices 30BK, 30Y, 30M and 30C are the same, a configuration of the image forming device 30BK is explained as a representative configuration.

The image forming device 30BK is configured with a photosensitive drum 31BK as an electrostatic latent image carrier that carries a toner image in black color on a surface the photosensitive drum 31BK, and the following devices that are located in order along a rotating direction "a" of the photosensitive drum 31BK: a charge device 32BK, an exposure device 33BK, a developer supply device 34BK and a cleaning device 35BK. The image forming device 30BK is located between the charge device 32BK and the developer supply device 34BK and receives exposure light from the exposure device 33BK. The photosensitive drum 31BK shown in FIG. 2 is in a drum shape. However, it is not necessary for the photosensitive drum 31BK to be in a drum shape. The photosensitive drum 31BK can be in a belt shape.

The transferring device 20 is driven in a driving direction "b" by rollers 22 and 23 through which an endless transferring medium 21 is tensioned so that the print medium 100 is sent to a medium carrying path on the transferring device 20.

The fuser device 40 that fuses a non-fused toner image on the print medium 100 is located at a downstream side of the medium carrying path on the transferring device 20. After the print medium 100 that is ejected from the fuser device 40 is carried by a roller 90, the print medium 100 is carried to the ejecting part 92 by a roller 91. Then, the print medium 100 is ejected to the print medium stack part 93. The print medium stack part 93 is a region to stack the printed print medium 100.

Figure 1A:
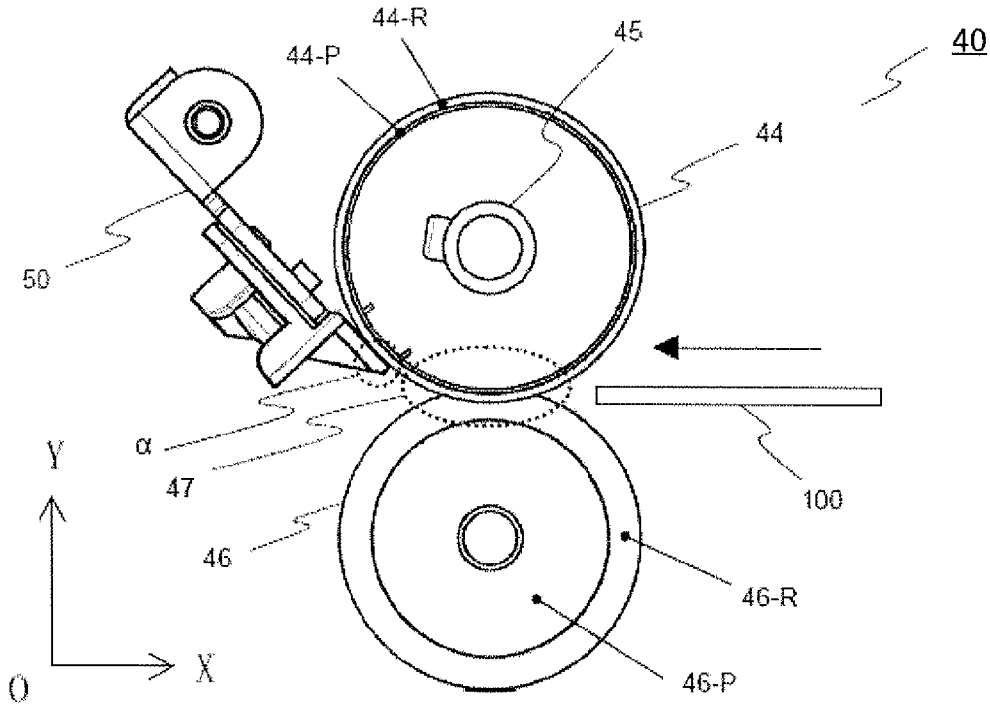
FIGS. 1A and 1B are schematic views of a fuser device of a first embodiment.
Figure 1B:
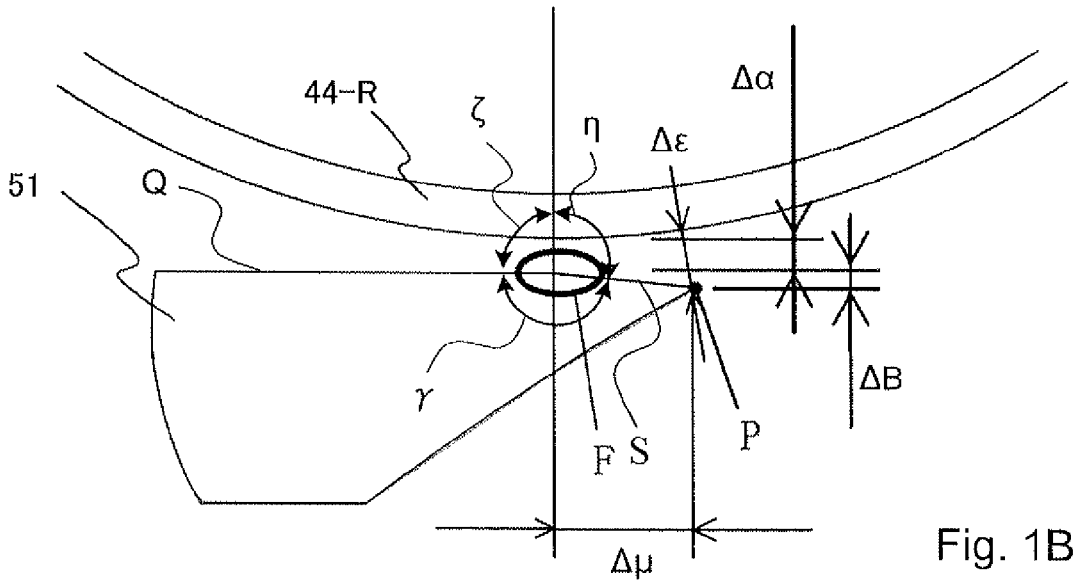

FIGS. 1A and 1B are schematic views of a fuser device shown in FIG. 2 of the first embodiment. FIG. 1A is a schematic view of an entire structure of the fuser device 40. FIG. 1B is an enlarged view of a medium separation area a in a separator 51 of a separation member 50.

The fuser device 40 is configured with a fuser member 44 that heats the print medium 100, a pressure member 46 that presses the print medium 100, and the separation member 50 that separates the print medium 100 from the fuser member 44.

The fuser member 44 is configured with a core metal part 44-P as a metal roller in a hollow circular cylindrical shape and an elastic layer 44-R as a heat-resistant elastic layer made of silicon rubber or the like that covers the core metal part 44-P. A halogen lamp 45 as a heating member is provided inside the hollow circular cylinder of the core metal part 44-P. Both end parts of the halogen lamp 45 are supported by support mediums (not shown). Both end parts of the core metal part 44-P are supported by rotatable support members (not shown).

The pressure member 46 is configured with a core metal part 46-P as a metal roller of a solid shaft and an elastic layer 46-R as a heat-resistant elastic layer made of a silicon rubber or the like that is formed on an outer circumference surface of the core metal part 46-P. Both end parts of the core metal part 46-P of the pressure member 46 are supported by rotatable support mediums (not shown) in a similar way of the fuser member 44. And the pressure member 46 is biased to press the fuser member 44 by a biasing member (not shown), such as a spring. The rotatable support mediums (not shown) are movable in only a Y direction.

A nipping region 47 that fixes a non-fused toner image on the print medium 100 is formed by biasing the elastic layer 46-R of the pressure member 46 toward the elastic layer 44-R of the fuser member 44 through the biasing member (not shown) so as to contact each other.

The separation member 50 has the separator 51 in a plate-like shape. A medium separation region $\alpha$ as a tip of the separator 51 is provided to be close to the fuser member 44.

The separator 51 shown in FIG. 1B has a planar part Q in a plate-like shape. The medium separation region $\alpha$ of the separator 51 bends so as to incline in a thickness direction of the planar part Q with a distance of $\Delta B$ (bend amount) by a bending process. A bend angle at a border part F between an inclined surface part S and the planar part Q is "$\gamma$." A width of the inclined surface part S from the border part F through a tip part P is $\Delta\mu$. Further, a back side of the inclined surface part S at the tip part P, i.e. a surface to which the bending process is applied, is chamfered (chipped off on a slant).

The width $\Delta\mu$ of the inclined surface part S between the border part F and the tip part P is preferably 0.5 mm-2.0 mm, and more preferably 0.8 mm-1.2 mm.

The angle $\gamma$ is obtuse and is preferably in a range of 120-178°. When the angle $\gamma$ is less than 120°, image quality is decreased due to a surface of the fuser member 44 being damaged by the border part F. Similarly, when the angle $\gamma$ is larger than 178°, image quality is also decreased due to the surface of the fuser member 44 being damaged by contact with the tip part P.

The angle $\gamma$ is more preferably in a range of 150-177°. When the angle $\gamma$ is in a range of 120-150°, image quality may not be decreased; but the surface of the fuser member 44 is damaged by the border part F. One the other hand, when the angle $\gamma$ is in a range of 177-178°, image quality may not be decreased; but the surface of the fuser member 44 is damaged due to contact with the tip part P.

The separator 51 is located in the vicinity of the elastic layer 44-R of the fuser member 44 with a gap distance of $\Delta\alpha$ therebetween. In FIG. 1B, the separator 51 is located as close as possible to the fuser member 44 at the border part F, and its gap distance is $\Delta\alpha$. The gap distance $\Delta\alpha$ is preferably in a range of 0.3 mm-1.0 mm, and more preferably 0.4 mm-0.6 mm.

An angle "$\zeta$" (or second angle) is between the planar part Q of the separator 51 and a perpendicular direction to the surface of the fuser member 44. An angle "$\eta$" (or first angle) is between the inclined surface part S of the separator 51 and a perpendicular direction to the surface of the fuser member 44. The angle $\zeta$ is preferably equal to or larger than 90°. And the angle "$\eta$" is preferably in a range of 88.2-107.2°.

Figure 3:
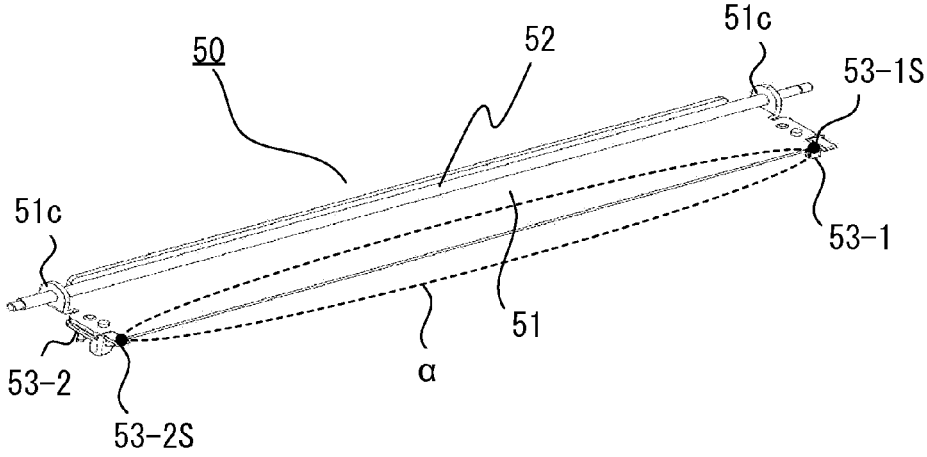
FIG. 3 is a schematic view showing an outer appearance of a separation member shown in FIGS. 1A and 1B.

FIG. 3 is a schematic view showing an outer appearance of the separation member 50 shown in FIGS. 1A and 1B. The separation member 50 is configured with the separator 51 in a rectangular plate-like shape, a shaft 52 that is provided at an end part of one of the long sides of the separator 51, and guide members 53-1 and 53-2 (spacer members) that are provided at both ends of the short sides of the separator 51.

Rigidity of the separator 51 against flexure in a longitudinal direction is increased by folding one of the long sides of the separator 51. Both short sides of the separator 51 are folded and have an aperture on the folded parts, respectively. The separator 51 has the shaft 52 that passes through the apertures located on the folded parts in the short sides. The separator 51 is supported under a state in which the separator 51 is rotatable as the shaft 52 is rotatable support. The guide members 53-1 and 53-2 are fixed to edge parts of the short sides of the separator 51 by fixing screws 54-1 and 54-2, respectively, shown in FIG. 4. The gap distance $\Delta\alpha$ between the medium separation region $\alpha$ located in the tip of the separator 51 and the fuser member 44 is constant by contacting contact surfaces 53-15 and 53-2S of the guide members 53-1 and 53-2 to the surface of the fuser member 44, respectively.

The guide members 53-1 and 53-2 are biased to contact the fuser member 44 by a biasing member (not shown), respectively. The separator 51 is provided to have a predetermined gap (equal to the gap distance $\Delta\alpha$) with respect to the fuser member 44.

Figure 4:
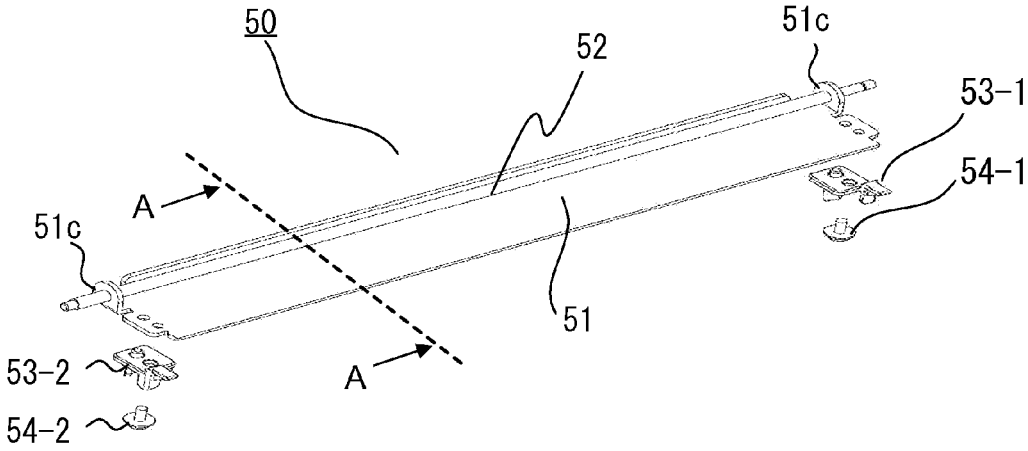
FIG. 4 is an exploded view of the separation member shown in FIG. 3.

FIG. 4 is an exploded view of the separation member 50 shown in FIG. 3. The guide members 53-1 and 53-2 are fixed to a back surface of the separator 51 by the fixing screws 54-1 and 54-2, respectively.

Figure 5:
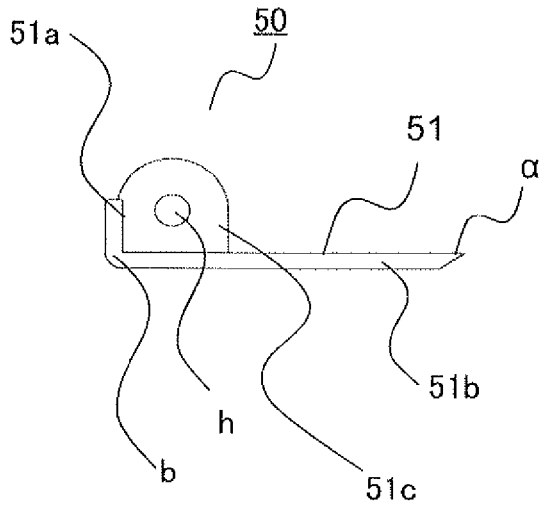
FIG. 5 a sectional view of a separator taken along line A-A shown in FIG. 4.

FIG. 5 a sectional view of the separator 51 taken along line A-A shown in FIG. 4. The separator 51 has the medium separation region $\alpha$ at an end of the long side opposite to the side to which the shaft 52 is attached. The medium separation region $\alpha$ is in an acute wedge shape. The medium separation region $\alpha$ of the separator 51 bends so as to incline in a thickness direction of the planar part Q with a distance of $\Delta B$ (bend amount) by a bending process. The back side of the medium separation region $\alpha$ of the separator 51 is chipped off on a slant so as to have a narrower thickness toward the tip part P. In FIG. 5, 51*a* represents a bent part that is bent from the planar part Q at a folding part "b"; 51*b* represents a plate-like-region part; 51*c* represents a held part; and "h" represents an aperture. As shown in FIGS. 3 and 4, the two held parts 51*c* are disposed on both sides of the separator 51, each of the held parts 51*c* having the aperture h that is illustrated in FIG. 5.

Figure 6:
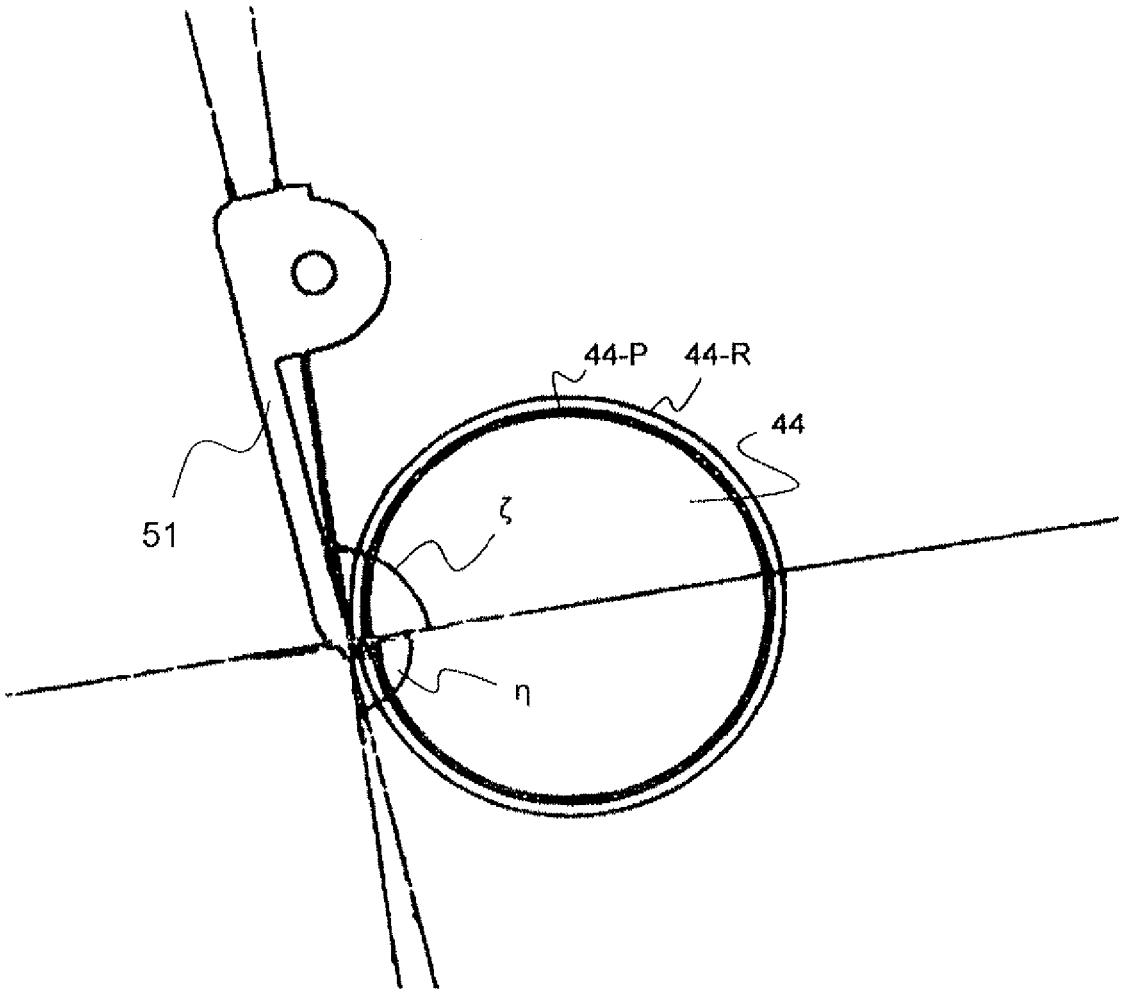
FIG. 6 is a schematic view showing an angle between a tip of the separator shown in FIG. 3 and a center part of a roller.

FIG. 6 is a schematic view showing an angle between a tip of the separator 51 shown in FIG. 3 and a center part of a roller. The separator 51 is located in the vicinity of the elastic layer 44-R and the fuser member 44. The angle "$\zeta$" is between the planar part Q of the separator 51 and a center direction of the fuser member 44, and at the same time is between the planar part Q of the separator 51 and a perpendicular direction to the surface of the fuser member 44. The angle "$\eta$" is between the inclined surface part S of the separator 51 and the center direction of the fuser member 44, and at the same time is between the inclined surface part S of the separator 51 and the perpendicular direction to the surface of the fuser member 44.

Operation of First Embodiment

In FIGS. 1A, 1B and 2, when a power source is applied to the image forming device 10, the fuser device 40 according to the first embodiment is ready to perform good fusing so as to complete preparation. Thus, fusing can be performed by the fuser device 40; and image formation can be performed by the image forming device 10.

When the image forming device 10 receives a print instruction, the print medium 100 is carried to the transferring device 20 by the registration roller 12. The photosensitive drum 31BK of the image forming device 30BK is charged by the charge device 32BK in accordance with rotation of the photosensitive drum 32BK. Then, an electrostatic latent image that corresponds to image information is formed by exposure light from the exposure device 33BK. This electrostatic latent image is developed by the developer supply device 34BK.

The print medium 100 is carried on the transferring device 20. Then, a developer image that is formed on the photosensitive drum 31BK is transferred on the print medium 100. Remaining developer is scraped by the cleaning device 35BK after the transferring so that the photosensitive drum 31BK is ready for the next charge. The print medium 100 in which the developer in black is transferred is carried by the transferring device 20 for transferring developers in yellow, magenta and cyan through the image forming devices 30Y, 30M and 30C, respectively, in a similar manner to the above mentioned image forming processes in the image forming device 30BK. After all developers that are required for image forming are transferred on the print medium 100, the print medium 100 is carried from the transferring device 20 to the fuser device 40.

Figure 7:
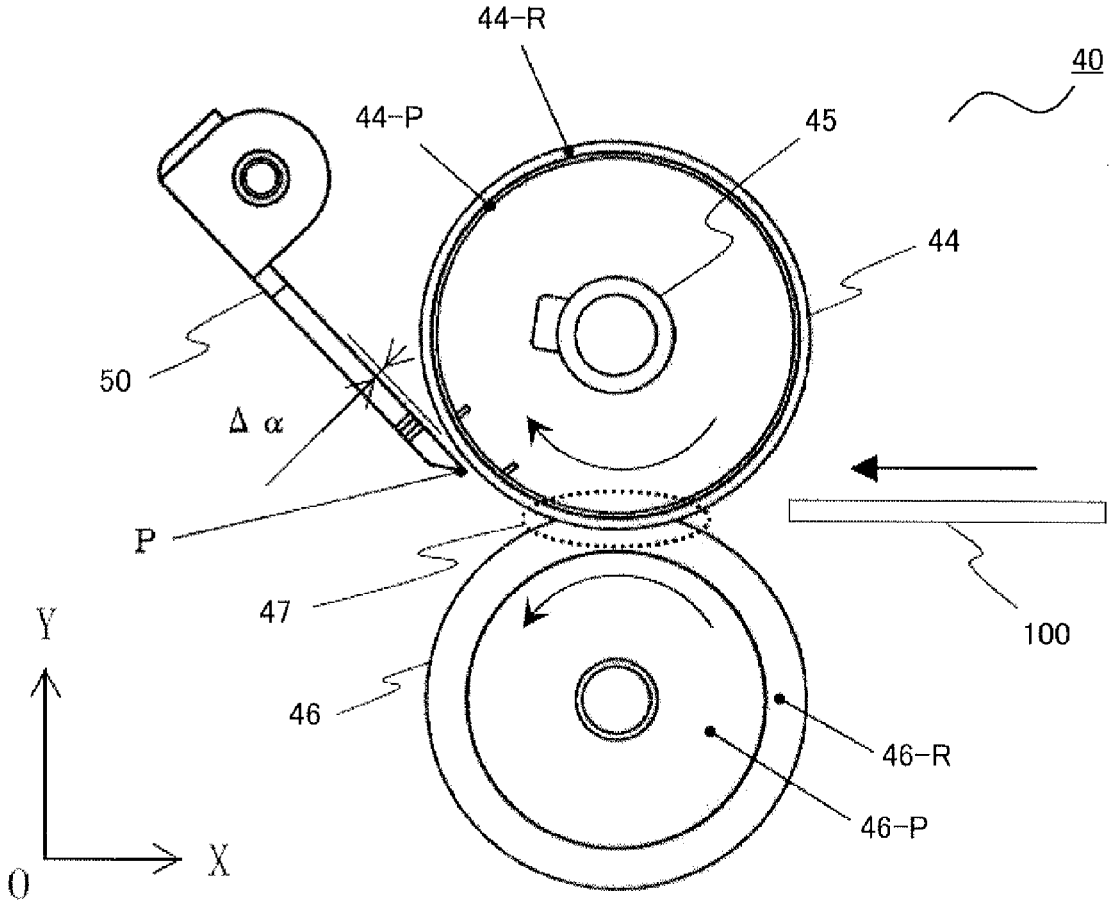
FIG. 7 is a schematic view showing movement of the fuser device shown in FIGS. 1A and 1B.

FIG. 7 is a schematic view showing movement of the fuser device 40 shown in FIGS. 1A and 1B. Heating of the fuser member 44 is started by using the halogen lamp 45 in order to perform thermal compression for the developer image that is formed on the print medium 100.

When the fuser member 44 rotates by receiving rotational motion from a driving system (not shown), the print medium 100 is carried to the nipping region 47 that is provided by the fuser member 44 and the pressure member 46, and thermal compression is applied thereto. As a result, the developer image is fused on the print medium 100.

When the image forming device 10 or the fuser device 40 receives an impact or shock from the outside, the separator 51 in a plate-like shape or the fuser member 44 is likely to be deformed or dislocated by flexure. As a result, a portion of the medium separation region $\alpha$ other than the vicinity of the guide members 53-1 and 53-2 of the separator 51 may contact the elastic layer 44-R of the fuser member 44.

In the separator 51 of the fuser device 40 shown in FIG. 1B, the tip part P of the medium separation region $\alpha$ bends in the thickness direction of the separator 51 so that the inclined surface part S of the medium separation region $\alpha$ is located away from the fuser member 44. A distance between the tip part P and the elastic layer 44-R is larger than a distance between the border part F or the inclined surface part S and the elastic layer 44-R. Therefore, the tip part P is not as close to the elastic layer 44-R as the border part F and the inclined surface part S. When the fuser member 44 receives an impact or shock, the elastic layer 44-R strongly contacts the border part F and the inclined surface part S, not the tip part P. As a result, since the elastic layer 44-R is not damaged by the impact or shock, good fusing can be performed.

Figure 8:
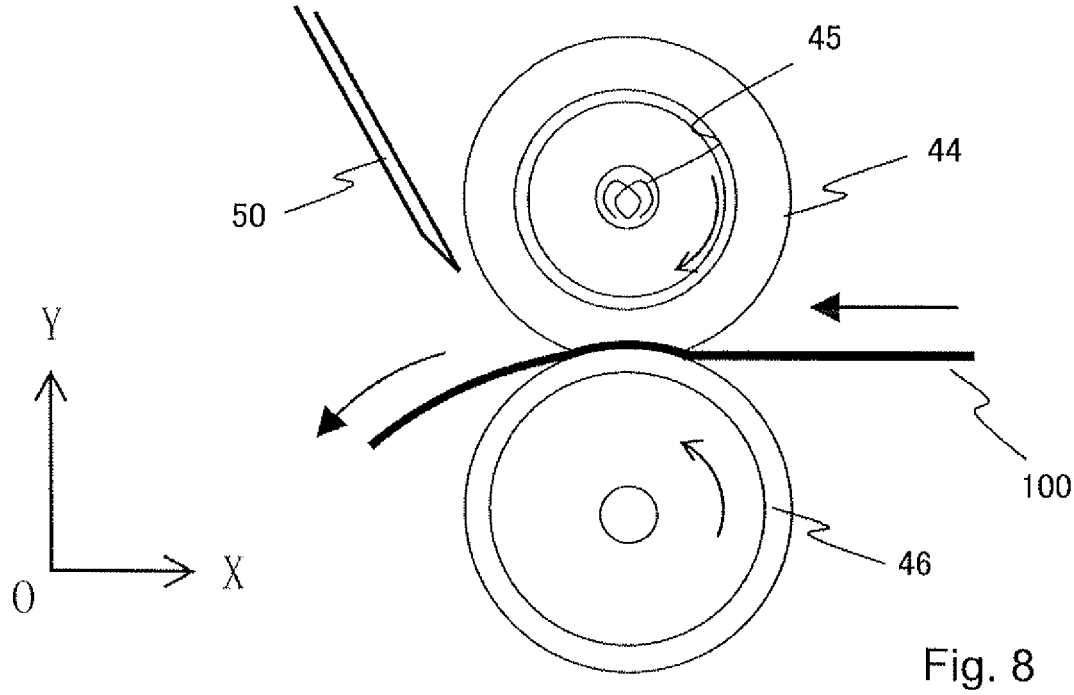
FIG. 8 is a schematic view of an ejecting sheet condition in a negative Y (−Y) direction of the fuser device shown in FIGS. 1A and 1B.

FIG. 8 is a schematic view of an ejecting sheet condition in a negative Y (−Y) direction of the fuser device 40 shown in FIGS. 1A and 1B. When a hardness of the elastic layer 46-R of the pressure member 46 is larger than that of the elastic layer 44-R of the fuser member 44, a contact region between the elastic layers 46-R and 44-R is in a convex shape in a positive (+Y) direction.

Thermal compression is applied to the print medium 100 at the nipping region 47. Also, the convex contact shape is applied in the +Y direction through pressure. Therefore, the print medium 100 is ejected in the condition in which a front end of the print medium 100 is curled in the −Y direction.

Figure 9:
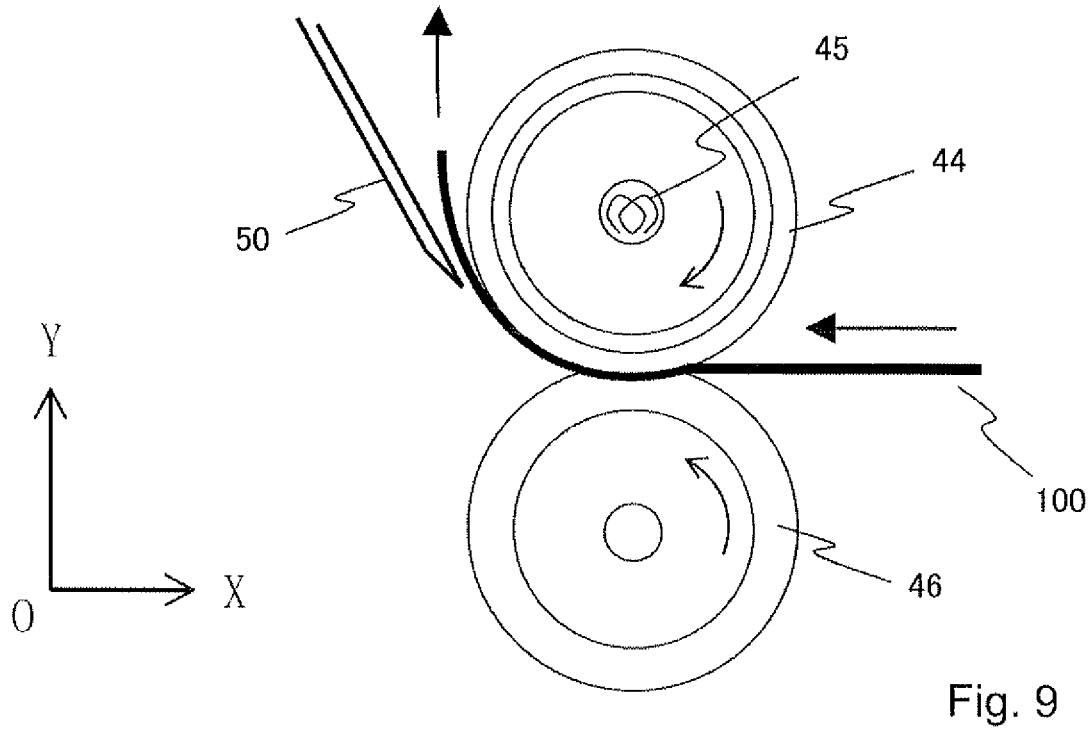
FIG. 9 is a schematic view of an ejecting sheet wrapping condition in a positive Y (+Y) direction of the fuser device shown in FIGS. 1A and 1B.

FIG. 9 is a schematic view of an ejecting sheet wrapping condition in the +Y direction of the fuser device 40 shown in FIGS. 1A and 1B. When a hardness of the elastic layer 44-R of the fuser member 44 is larger than that of the elastic layer 46-R of the pressure member 46, a contact region between the elastic layers 46-R and 44-R is in a convex shape in the −Y direction. Thermo compression is applied to the print medium 100 at the nipping region 47. Also, the convex contact shape is applied in the −Y direction through pressure. Therefore, the print medium 100 is ejected in the condition in which a front end of the print medium 100 is curled in the +Y direction. In this case, when the gap distance Δα between the fuser member 44 and the separator 51 is large, the print medium 100 is not separated from the fuser member 44 by the separator 51 and is carried in the condition in which the print medium 100 is wrapped around the fuser member 44. As a result, a paper jam occurs.

Experimental Results of First Embodiment

FIGS. 10-16 are charts for results of drop and sheet separation experiments.

In the drop and sheet separation experiments, a hardness of the fuser member 44 was 90°; a hardness of the pressure member 46 is 70°; an angle "ζ" is 94.8°; and a width Δμ of the inclined surface part S between the border part F and the tip part P is 1.0 mm. Note that a hardness is an ASKER-C hardness; and after a roll shape is formed by forming the elastic layers 44-R and 46-R on the core metal parts 44-P and 46-P, respectively, the ASKER-C hardness is measured by an ASKER-C hardness gauge.

As a result of the drop experiments, a mark "○" represents a situation in which when the fuser member 44 according to the present embodiment was naturally dropped from a height of 1.0 m, and there is no damage on the surface of the fuser member 44. Similarly, a mark "Δ" represents a situation in which there is minor damage on the surface of the fuser member 44, but which does not decrease image quality (minor damage) under the same situation above. Similarly, a mark "x" represents a situation in which there is damage on the surface of the fuser member 44, and which decreases image quality.

In the sheet separation experiments, the print medium 100 of a P sheet (thin sheet) is carried at a speed of 36 ppm by longitudinal feeding of an A4 size sheet. These experiments were performed under the following conditions. The print medium 100 with two types of situations, i.e. 100% of a developer image and 270% of a developer image, are tested at a temperature of 30° C., humidity of 80%, and at a fusing temperature of 170° C. The 100% of the developer image means that a single color developer is formed on the print medium 100 without space. The 270% of the developer image means that 90% each of CMY (cyan, magenta, and yellow) developer is formed on the print medium 100.

As a result of the sheet separation experiments, a mark "○" represents a situation in which a sheet can be separated from the fuser member 44 after a fusing process. Similarly, a mark "x" represents a situation in which a sheet cannot be separated from the fuser member 44 after the fusing process.

As a result of a comprehensive evaluation, a mark "◎" represents the most preferred situation in which the results of the drop experiments, and the sheet separation experiments of both the 100% and 270% of the developer images are the marks "○." Similarly, a mark "○" as a result of the comprehensive evaluation represents a situation in which there are no practical problems, i.e. the results of the drop experiments and the sheet separation experiments of the 100% of the developer images are the marks "○," or the result of the drop experiments is the mark "Δ" and at least the result of the sheet separation experiments of the 100% of the developer image is the mark "○." Similarly, a mark "x" as a result of the comprehensive evaluation represents an unfavorable situation in which the results of the drop experiments and the sheet separation experiments of the 100% of the developer image are the marks "x."

FIG. 10 is a chart for results of the drop and sheet separation experiments with a condition in which Δα is equal to 0.2 mm (Δα=0.2 mm).

When the bend amount ΔB is varied in a range of 0 mm-0.4 mm (the angle "η" is varied in a range of 85.2°-107.2°), all the results of the comprehensive evaluation are the marks "x." In this case, all the results of the drop experiments are the mark "x"; and all the results of the sheet separation experiments of the 100% and the 270% of the developer images are the marks "○."

FIG. 11 is a chart for results of the drop and sheet separation experiments with a condition in which Δα is equal to 0.3 mm (Δα=0.3 mm).

In a situation in which the bend amount ΔB is varied in a range of 0 mm-0.4 mm, when the bend amount ΔB is 0 mm, the result of the comprehensive evaluation is the unfavorable mark "x"; however, when the bend amount is equal to or more than 0.05 mm, the results of the comprehensive evaluation are the marks "○" which mean that there are no practical problems. When the bend amount ΔB is 0 mm, the result of the drop experiments is the mark "x." But, when the bend amount ΔB is equal to or more than 0.05 mm, the results of the drop experiments are the marks "Δ." All the results of the sheet separation experiments of the 100% and the 270% of the developer images are the marks "○."

With respect to a situation in which the angle "η" is varied in a range of 85.2°-107.2°, when the angle "η" is 85.2°, the result of the comprehensive evaluation is the unfavorable mark "x." However, the angle "η" is between 88.2°-107.2°, the results of the comprehensive evaluation are the marks "○" that mean that there are no practical problems.

FIG. 12 is a chart for results of the drop and sheet separation experiments with a condition in which Δα is equal to 0.4 mm (Δα=0.4 mm).

In a situation in which the bend amount ΔB is varied in a range of 0 mm-0.4 mm, when the bend amount ΔB is 0 mm, the result of the comprehensive evaluation is the unfavorable mark "x"; however, when the bend amount is equal to or more than 0.05 mm, the results of the comprehensive evaluation are the most preferred marks "◎." When the bend amount ΔB is 0 mm, the result of the drop experiment is the mark "x." But, when the bend amount ΔB is equal to or more than 0.05 mm, the results of the drop experiments are the marks "○." All the results of the sheet separation experiments of the 100% and the 270% of the developer images are the marks "○".

With respect to a situation in which the angle "η" is varied in a range of 85.2°-107.2°, when the angle "η" is 85.2°, the result of the comprehensive evaluation is the unfavorable mark "x." However, the angle "η" is between 88.2°-107.2°, the results of the comprehensive evaluation are the most preferred marks "◎."

FIG. 13 is a chart for results of the drop and sheet separation experiments with a condition in which Δα is equal to 0.6 mm (Δα=0.6 mm).

In a situation in which the bend amount ΔB is varied in a range of 0 mm-0.4 mm, when the bend amount ΔB is 0 mm, the result of the comprehensive evaluation is the unfavorable mark "x"; however, when the bend amount is in a range of 0.05 mm-0.2 mm, the results of the comprehensive evaluation are the most preferred marks "◎"; and when the bend amount is in a range of 0.3 mm-0.4 mm, the results of the comprehensive evaluation are the marks "○" which mean that there are no practical problems. When the bend amount ΔB is 0 mm, the result of the drop experiment is the mark "x." But, when the bend amount ΔB is equal to or more than 0.05 mm, the results of the drop experiments are the marks "○." All the results of the sheet separation experiments of the 100% of the developer images are the marks "○." When the bend amount is in a range of 0 mm-0.2 mm, the results of the sheet separation experiments of the 270% of the developer images are the marks "○." When the bend amount is in a range of 0.3 mm-0.4 mm, the results of the sheet separation experiments of the 270% of the developer images are the marks "x."

With respect to a situation in which the angle "η" is varied in a range of 85.2°-107.2°, when the angle "η" is 85.2°, the result of the comprehensive evaluation is the unfavorable mark "x." However, the angle "η" is between 88.2°-96.2°, the results of the comprehensive evaluation are the most preferred marks "◎." The angle "η" is between 102.2°-107.2°, the results of the comprehensive evaluation are the marks "○" which means that there are no practical problems.

FIG. 14 is a chart for results of the drop and sheet separation experiments with a condition in which Δα is equal to 1.0 mm (Δα=1.0 mm).

In a situation in which the bend amount ΔB is varied in a range of 0 mm-0.4 mm, when the bend amount ΔB are 0 mm and in a range of 0.3 mm-0.4 mm, the results of the comprehensive evaluation are the unfavorable marks "x"; however, when the bend amount is in a range of 0.05 mm-0.2 mm, the results of the comprehensive evaluation are the marks "○" that mean that there are no practical problems. When the bend amount ΔB is 0 mm, the result of the drop experiments is the mark "x." But, when the bend amount ΔB is equal to or more than 0.05 mm, the results of the drop experiments are the marks "○." When the bend amount is in a range of 0 mm-0.2 mm, the results of the sheet separation experiments of the 100% of the developer images are the marks "○." When the bend amount is in a range of 0.3 mm-0.4 mm, the results of the sheet separation experiments of the 100% of the developer images are the marks "x." All the results of the sheet separation experiments of the 270% of the developer images are the marks "○."

With respect to a situation in which the angle "η" is varied in a range of 85.2°-107.2°, when the angle "η" are 85.2° and in a range of 102.2°-107.2°, the results of the comprehensive evaluation are the unfavorable marks "x." However, when the angle "η" is between 88.2°-96.2°, the results of the comprehensive evaluation are the marks "○" which means that there are no practical problems.

FIG. 15 is a chart for results of the drop and sheet separation experiments with a condition in which Δα is equal to 1.5 mm (Δα=1.5 mm).

When the bend amount ΔB is varied in a range of 0 mm-0.4 mm (the angle "η" is varied in a range of 85.2°-107.2°), all the results of the comprehensive evaluation are the unfavorable marks "x." When the bend amount ΔB is 0 mm, the result of the drop experiment is the mark "x." But, when the bend amount ΔB is equal to or more than 0.05 mm, the results of the drop experiments are the marks "○." All the results of the sheet separation experiments of the 100% and the 270% of the developer images are the marks "x."

FIG. 16 is a chart for results of the drop and sheet separation experiments with a condition in which Δα is equal to 2.0 mm (Δα=2.0 mm).

When the bend amount ΔB is varied in a range of 0 mm-0.4 mm (the angle "η" is varied in a range of 85.2°-107.2°), all the results of the comprehensive evaluation are the unfavorable marks "x." All the results of the drop experiments are the mark "○." All the results of the sheet separation experiments of the 100% and the 270% of the developer images are the marks "x."

FIG. 17 is a chart for comprehensive determination of drop and sheet separation experiments. According to the comprehensive determination of the drop and sheet separation experiments shown in FIG. 17, preferred ranges are as follows: The gap distance Δα (or second gap distance) is in a range of 0.3 mm-1.0 mm, and the tip part gap Δϵ (or first gap distance) is in a range of 0.30 mm-1.15 mm. More preferred ranges are as follows: The gap distance Δα is in a range of 0.4 mm-0.6 mm, and the tip part gap Δϵ is in a range of 0.4 mm-0.75 mm. The most preferred ranges are as follows: The gap distance Δα is in a range of 0.4 mm-0.6 mm, and the tip part gap Δϵ is in a range of 0.60 mm-0.75 mm.

Figure 18:
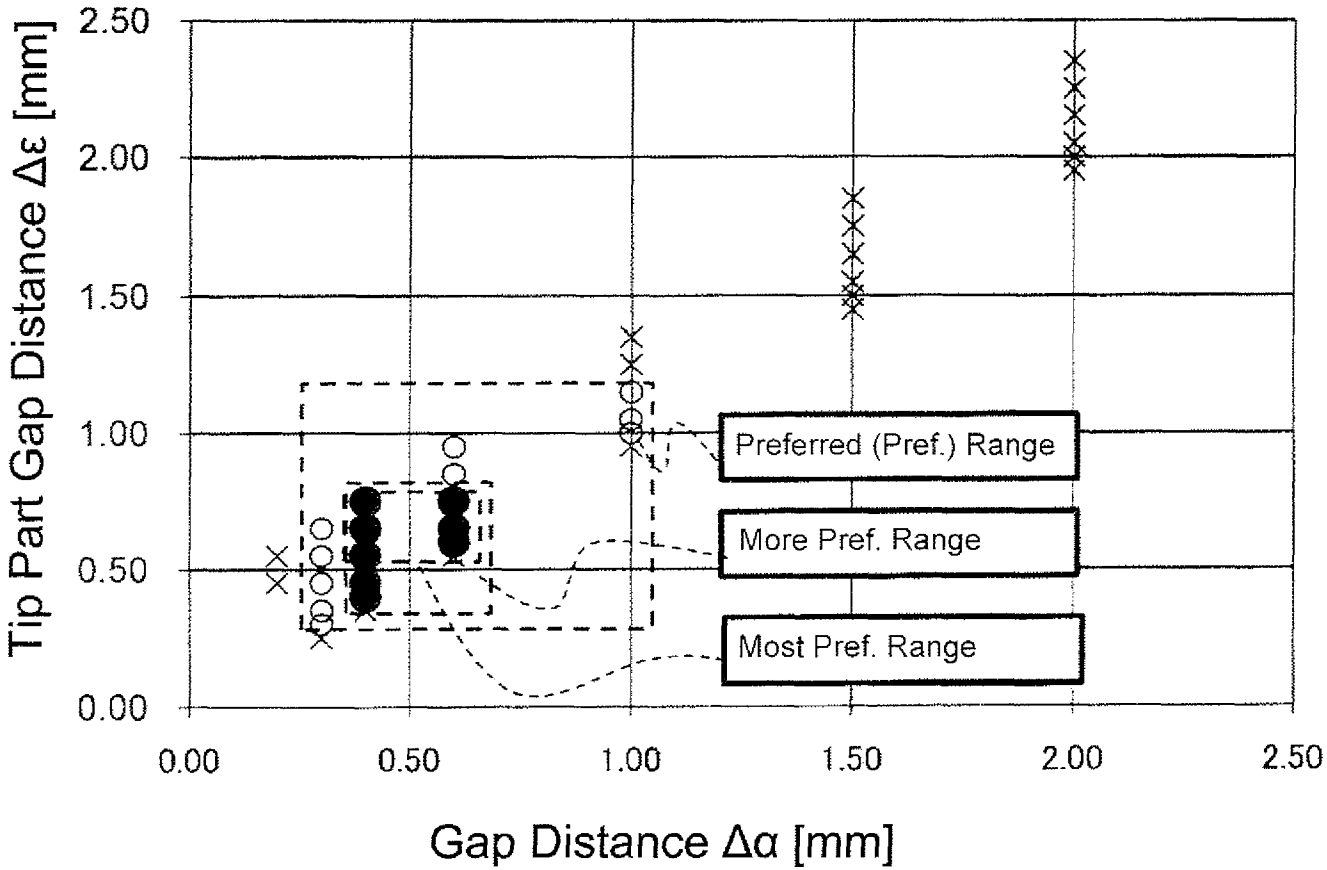
FIG. 18 is a graph showing a combination of a tip part gap ($\Delta\epsilon$) and gap distance ($\Delta\alpha$), and comprehensive determination.

FIG. 18 is a graph showing a combination of the tip part gap (Δϵ) and the gap distance (Δα), and a comprehensive determination. A Y-axis of FIG. 18 shows the tip part gap Δϵ [mm]. An X-axis of FIG. 18 shows the gap distance Δα [mm]. As a result of the comprehensive determination in FIG. 18, a mark "●" represents the most preferred situation. Similarly, a mark "○" represents a situation in which there are no practical problems. Similarly, a mark "x" represents an unfavorable situation.

According to the comprehensive determination of the drop and sheet separation experiments shown in FIG. 18, preferred ranges are as follows: The gap distance Δα is in a range of 0.3 mm-1.0 mm, and the tip part gap Δϵ is in a range of 0.30 mm-1.15 mm. More preferred ranges are as follows: The gap distance Δα is in a range of 0.4 mm-0.6 mm, and the tip part gap Δϵ is in a range of 0.40 mm-0.75 mm. The most preferred ranges are as follows: The gap distance Δα is in a range of 0.4 mm-0.6 mm, and the tip part gap Δϵ is in a range of 0.60 mm-0.75 mm.

Figure 19:
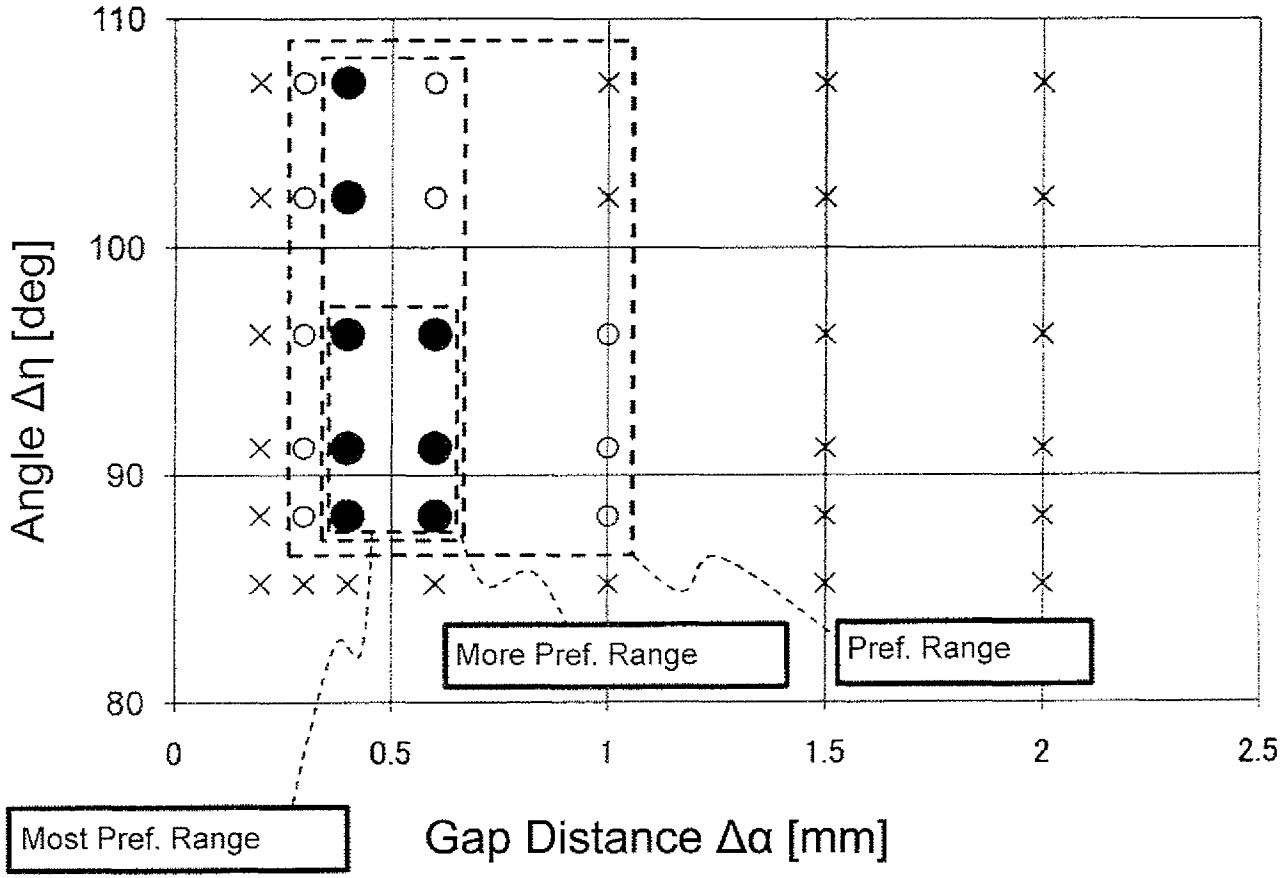
FIG. 19 is a graph showing a combination of an angle "$\eta$" and gap distance ($\Delta\alpha$), and comprehensive determination.

FIG. 19 is a graph showing a combination of the angle "η" and the gap distance (Δα), and a comprehensive determination. A Y-axis of FIG. 19 shows the angle "η" [degree]. An X-axis of FIG. 19 shows the gap distance Δα [mm]. As a result of the comprehensive determination in FIG. 19, a mark "●" represents the most preferred situation. Similarly, a mark "○" represents a situation in which there are no practical problems. Similarly, a mark "x" represents an unfavorable situation.

According to the comprehensive determination of the drop and sheet separation experiments shown in FIG. 19, preferred ranges are as follows: The angle "η" is in a range of 88.2°-107.2°, and the gap distance Δα is in a range of 0.3 mm-1.0 mm. More preferred ranges are as follows: The angle "η" is in a range of 88.2°-107.2°, and the gap distance Δα is in a range of 0.4 mm-0.6 mm. The most preferred ranges are as follows: The angle "η" is in a range of 88.2°-96.2°, and the gap distance Δα is in a range of 0.4 mm-0.6 mm.

Effects of First Embodiment

The fuser device 40 and the image forming device 10 according to the first embodiment have effects (A)-(D) discussed below.

(A) Because the medium separation region α of the separator 51 bends, the tip part P of the separator 51 does not cause damage to the fuser member 44 when the image forming device 10 or the fuser device 40 receives an impact or shock from the outside. As a result, good fusing can be performed, and image quality is increased. When the image forming device 10 or the fuser device 40 receives an impact or shock from the outside during their transportation or when they are dropped, there is a possibility that the separator 51 and the fuser member 44 are deformed or dislocated by flexure. However, since the medium separation region α of the separator 51 bends, the tip part P of the separator 51 does not cause damages to the fuser member 44.

(B) Because the separator 51 has a simple shape where formation of a bend is applied on its plate-like shape, it can be manufactured with low cost.

(C) During the image forming device's 10 start-up process, heating and calibration (location adjustment) for the separator 51 is not required so that a quick start-up process of the image forming device 10 is realized.

(D) Because the separator 51 is located close to the fuser member 44, it is possible to prevent the print medium 100 from wrapping or adhering around the fuser member 44.

Second Embodiment

Configuration of Second Embodiment

Figure 20:
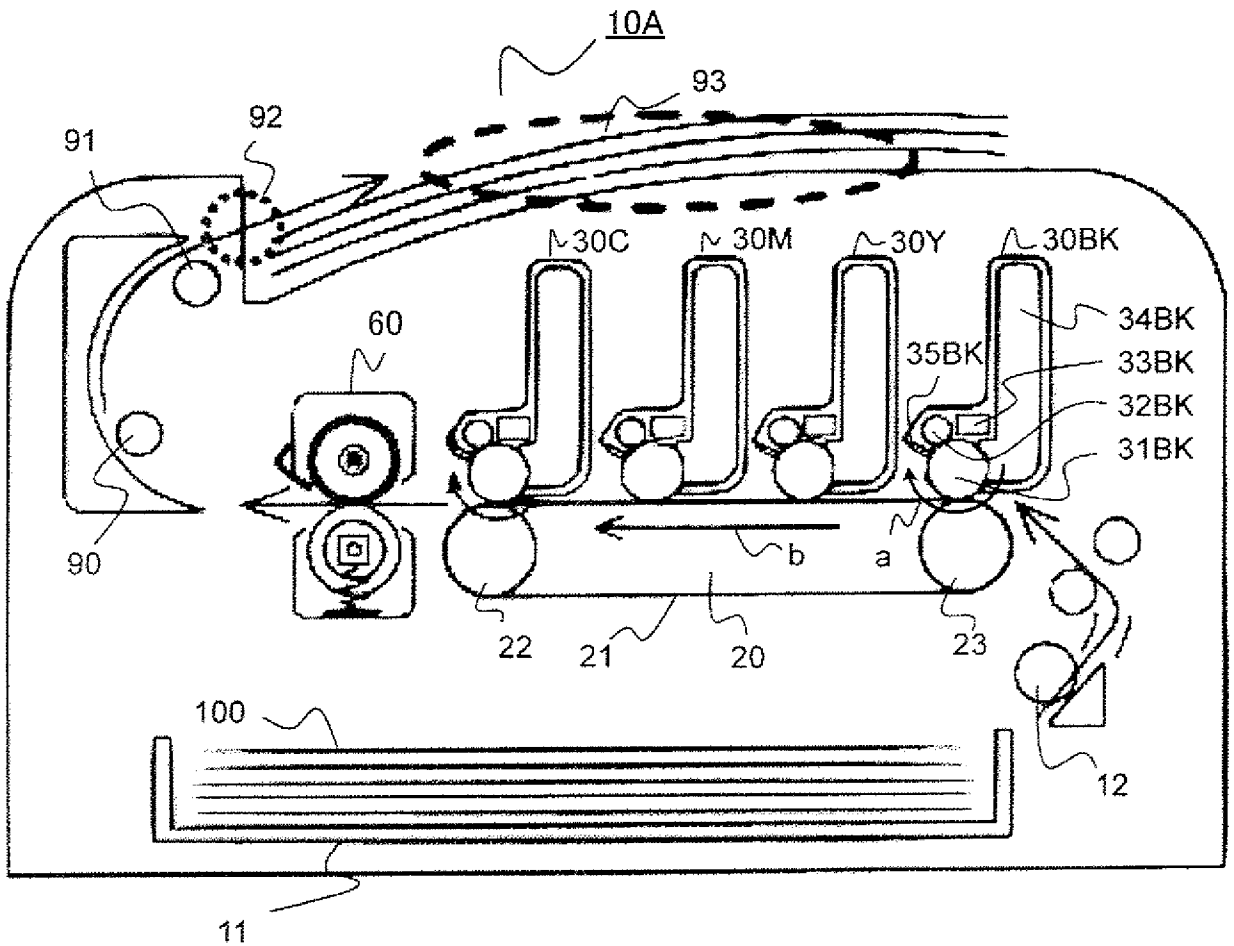
FIG. 20 is a schematic view of an image forming device in which a fuser device of a second embodiment is assembled.

FIG. 20 is a schematic view of an image forming device in which a fuser device of a second embodiment according to the present invention is assembled. Elements shown in FIG. 20 that are the same as elements shown in FIG. 2 of the first embodiment have common reference numerals.

A configuration of an image forming device 10A of the second embodiment is the same as the configuration of the image forming device 10 of the first embodiment shown in FIG. 2 except for a fuser device 60 that is different from the fuser device 40 of the first embodiment.

Figure 21:
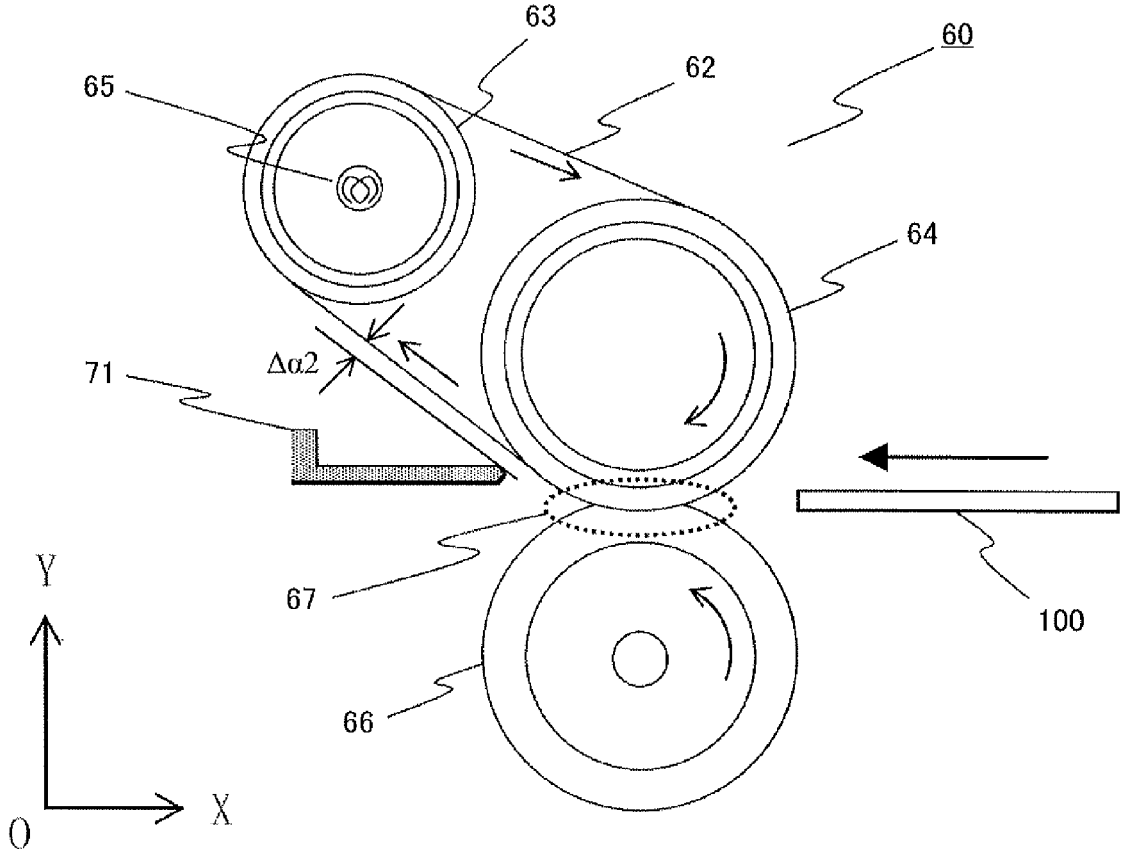
FIG. 21 is a schematic view of the fuser device of the second embodiment.

FIG. 21 is a schematic view of the fuser device 60 of the second embodiment according to the present invention. The fuser device 60 of the second embodiment is configured with a heat roller 63 as a metal roller in a hollow circular cylindrical shape, a halogen lamp 65 that is located inside the hollow circular cylinder of the heat roller 63, a fuser roller 64, a fuser belt 62 that is tensioned between the heat roller 63 and the fuser roller 64, a pressure application roller 66 that presses the fuser roller 64, a separation member (not shown) that separates the print medium 100 from the fuser belt 62, and a separator 71 of the separation member.

The fuser belt 62 is tensioned between the fuser roller 64 and the heat roller 62 in which the halogen lamp 65 is located inside. Both end parts of the heat roller 63, the fuser roller 64, and the pressure application roller 66 are supported by rotatable bearings (not shown), respectively. The pressure application roller 66 is biased in the +Y direction by a biasing member (not shown) so as to press the fuser roller 64.

A nipping region 67 that is to fuse a non-fused toner image on the print medium 100 is provided by biasing and contacting the pressure application roller 66 through a biasing member (not shown) to the fuser roller 64 in the same manner of the nipping region 47 described in the first embodiment.

The separation member (not shown) includes the separator 71 in a plate-like shape. A tip of the separator 71 is located close to the nipping region 67 with a gap distance Δα2. The separator 71 has chamfered parts C1 and C2 that are close to the fuser belt 62. Surfaces of the chamfered parts C1 and C2 are coated by polytetrafluoroethylene (PTFE) to prevent developer from adhering.

Figure 22:
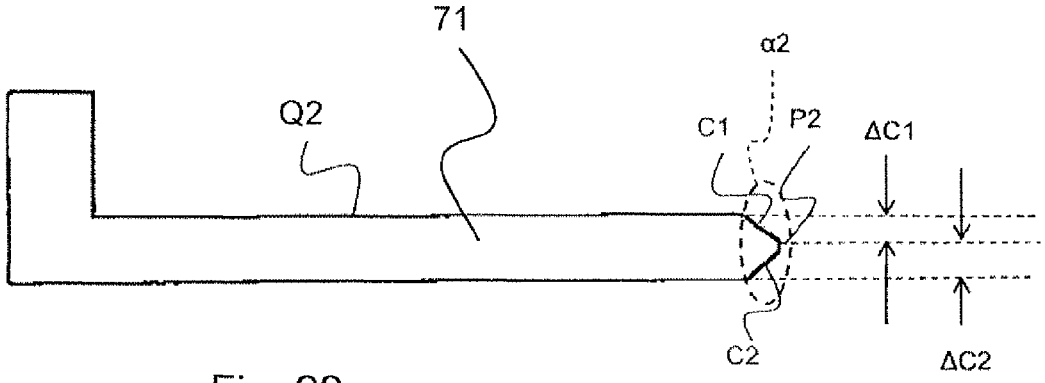
FIG. 22 is a sectional view of a separator shown in FIG. 21.

FIG. 22 is a sectional view of the separator 71 shown in FIG. 21. The separator 71 bends on the left side and has a planar part Q2. A medium separation region α2 is located on the right side of the planar part Q2. The medium separation region α2 includes the chamfered parts C1 and C2 and a tip part P2. The chamfered part C1 is inclined with a distance of ΔC1 in a thickness direction of the planar part Q2. The chamfered part C2 that is formed at the back side of the chamfered part C1 is also inclined with a distance of ΔC2 in the thickness direction of the planar part Q2. The tip part P2 is formed by the chamfered parts C1 and C2.

Figure 23:
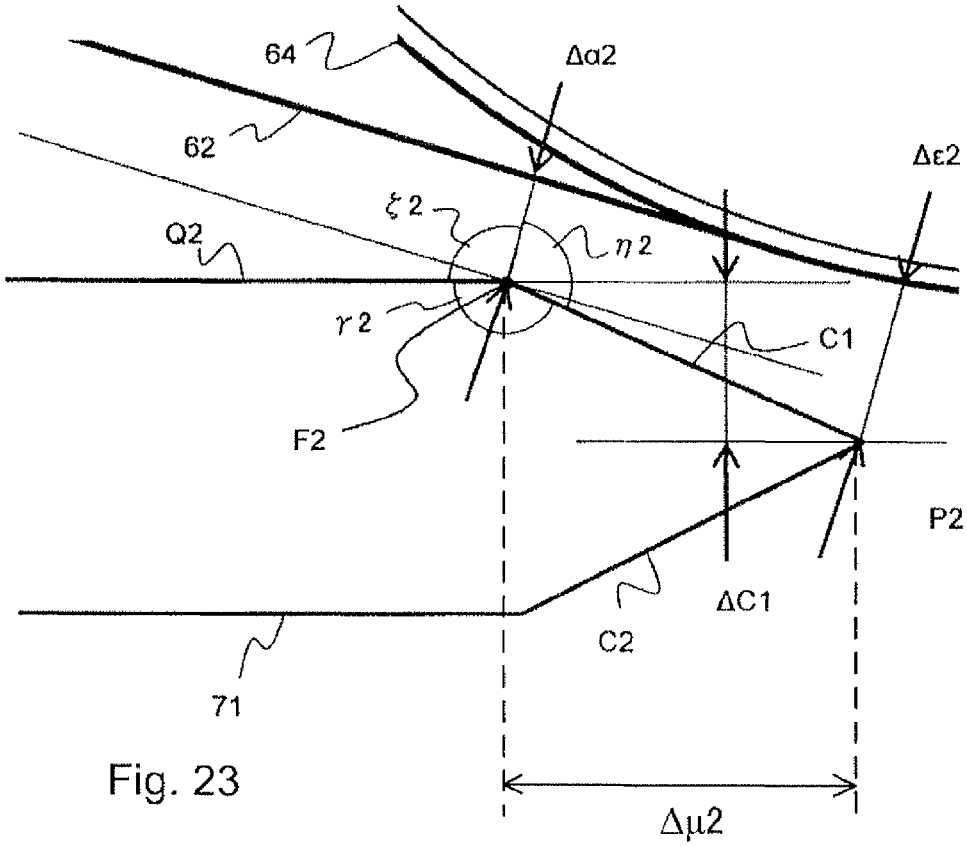
FIG. 23 is an enlarged view of a tip of a separator shown in FIG. 21.

FIG. 23 is an enlarged view of the tip of the separator 71 shown in FIG. 21. The separator 71 has the planar part Q2. The separator 71 has the chamfered part C1 that is inclined with the distance of ΔC1 in the thickness direction of the planar part Q2 and the chamfered part C2 that is formed at the back side of the chamfered part C1 is inclined with a distance of ΔC2 in the thickness direction of the planar part Q2 in the vicinity of the medium separation region α2 of the planar part Q2. The chamfered parts C1 and C2 are formed by chamfering the corners.

An angle at a border part F2 between the chamfered part C1 and the planar part Q2 is defined as "γ2." A width of the chamfered part C1 from the border part F2 through the tip part P2 is defined as "Δμ2."

The width Δμ2 of the chamfered part C1 from the border part F2 through the tip part P2 is preferably in a range of 0.5 mm-2.0 mm in the same manner of the width Δμ of the first embodiment, and is more preferably in a range of 0.8 mm-1.2 mm.

The angle γ2 is obtuse and is preferably in a range of 120-178° in the same manner of the angle γ of the first embodiment. When the angle γ2 is less than 120°, image quality is where a surface of the fuser belt 62 is damaged by the border part F2. Similarly, when the angle γ2 is larger than 178°, image quality is also decreased due to the surface of the fuser belt 62 being damaged by contact with the tip part P2.

The angle γ2 is more preferably in a range of 150-177° in the same manner of the angle γ of the first embodiment. When the angle γ2 is in a range of 120-150°, image quality may not be decreased; but the surface of the fuser belt 62 is damaged by the border part F2. Similarly, when the angle γ2 is in a rage of 177-178°, image quality may not be decreased; but the surface of the fuser belt 62 is damaged by contacting with the tip part P2.

An angle "ζ2" is between the planar part Q2 of the separator 71 and a perpendicular direction to the surface of the fuser belt 62. An angle "η2" is between the chamfered part C1 of the separator 71 and a perpendicular direction to the surface of the fuser belt 62. The angle ζ2 is preferably equal to or larger than 90° in the same manner of the angle "ζ" of the first embodiment. Also, the angle "η2" is preferably in a range of 88.2-107.2° in the same manner of the angle "η" of the first embodiment.

The separator 71 is provided close to the fuser belt 62. Specifically, the separator 71 is located with the shortest distance toward the fuser belt 62 at the border part F2 between the planar part Q2 and the chamfered part C1. The separator 71 is away from the fuser belt 62 with a gap distance Δα2.

Operation of Second Embodiment

In FIGS. 20 and 21, when a power source is applied to the image forming device 10A, the fuser device 60 according to the second embodiment is ready to perform good fusing so as to complete preparation in the same manner of the fuser device 40 of the first embodiment. Then, fusing can be performed by the fuser device 60; and an image forming can be performed by the image forming device 10A.

An operation for carrying the print medium 100 through the fuser device 60 in the image forming device 10A of the second embodiment is the same as the first embodiment.

The print medium 100 is carried to the nipping region 67 for fusing a fuse. A hardness of the fuser roller 64 is larger than that of the pressure application roller 66. Therefore, the nipping region 67 is in a convex shape in the −Y direction. As a result, the print medium 100 is ejected in the direction of forward movement of the fuser belt 62 in the +Y direction.

Because the border part F2 of the separator 71 is close to the fuser belt 62 with the gap distance Δα2 as shown in FIG. 23, the print medium 100 is separated from the fuser belt 62 by the separator 71 and is ejected from the fuser device 60 along with the chamfered part C2.

A condition is considered that the image forming device 10A or the fuser device 60 receives an impact from the outside. For example, the impact might occur during their transportation or when they are dropped. When the separator 71 or the fuser belt 62 is deformed or dislocated by flexure, and when the separator 71 contacts the fuser belt 62, the border part F2 or the chamfered part C1 that is formed on the separator 71 interferes with the fuser belt 62. As a result, the fuser belt 62 is not damaged, a good fusing can be performed even after the image forming device 10A or the fuser device 60 receives the impact or shock.

"ΔC1" of the second embodiment is similar to "ΔB" of the first embodiment. The gap distance "Δα2" of the second embodiment is similar to the gap distance "Δα" of the first embodiment. The angles "γ2," "ζ2," and "η2" of the second embodiment are similar to the angles "γ," "ζ," and "η" of the first embodiment, respectively.

Effects of Second Embodiment

The fuser device 60 and the image forming device 10A according to the second embodiment have effects (A)-(D) discussed below.

(A) Because the chamfered parts C1 and C2 are formed at the medium separation region α2 in the separator 71, the tip part P2 of the separator 71 does not cause damage to the fuser belt 62 when the image forming device 10A or the fuser device 60 receives an impact or shock from outside. As a result, a good fusing can be performed, and image quality is increased.

(B) Because the separator 71 has a simple shape where the two chamfered parts are formed, it can be manufactured with lower cost compared with the separator 51 of the first embodiment.

(C) During the image forming device's 10A start-up process, heating and calibration (location adjustment) for the separator 71 is not required in the same manner as the first embodiment so that a quick start-up process of the image forming device 10A is realized.

(D) Because the separator 71 is located close to the fuser belt 62, it is possible to prevent the print medium 100 from wrapping or adhering around the fuser belt 62.

Third Embodiment

Configuration of Third Embodiment

Figure 24:
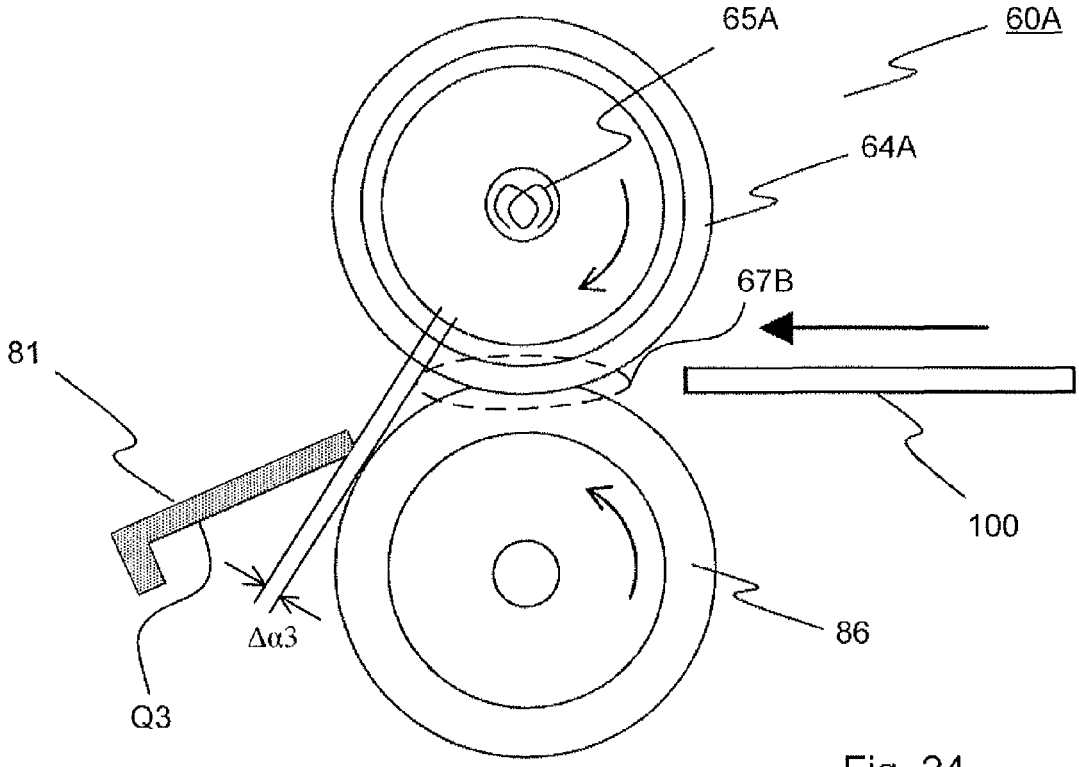
FIG. 24 is a schematic view of a fuser device of a third embodiment.

FIG. 24 is a schematic view of a fuser device of a third embodiment according to the present invention. Elements shown in FIG. 24 that are the same as elements shown in FIG. 21 of the second embodiment have common reference numerals.

A fuser device 60A of the third embodiment is provided at an image forming device 10B in the same manner as the second embodiment. The fuser device 60A includes the pressure application roller 66 that presses a fuser roller 64A in the same manner as the second embodiment, the fuser roller 64 in a hollow circular cylindrical shape that is different from the second embodiment, and the separator 81 as a separation member that separates the print medium 100 from the fuser roller 64A.

The halogen lamp 65 as a heating member is provided inside the hollow circular cylinder of the fuser roller 64A. Both end parts of the halogen lamp 65 are supported by support mediums (not shown). Both end parts of the fuser roller 64A and the pressure application roller 66 are supported by rotatable bearings (not shown), respectively.

A nipping region 67B that is to fuse a non-fused toner image on the print medium 100 is provided by biasing and contacting the pressure application roller 66 through a biasing member (not shown) to the fuser roller 64A.

The separation member (not shown) includes the separator 81 in a plate-like shape. A tip of the separator 81 is located close to the nipping region 67B by a shaft and a guide member (not shown).

Figure 25:
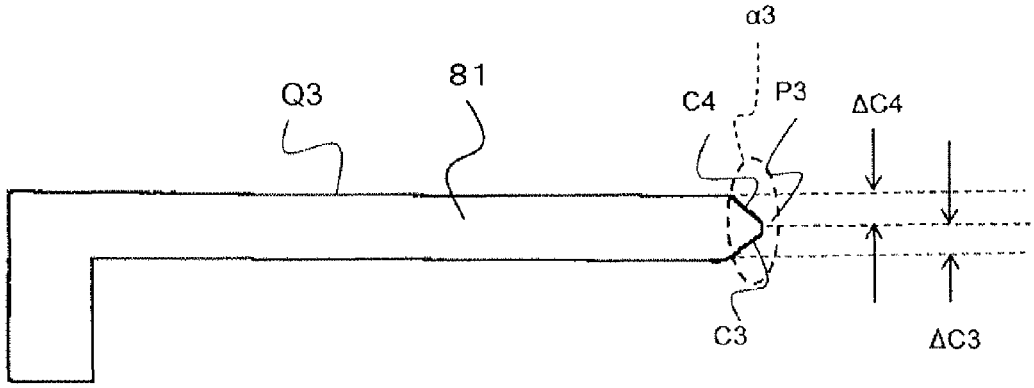
FIG. 25 is a sectional view of a separator shown in FIG. 24.

FIG. 25 is a sectional view of the separator 81 shown in FIG. 24. The separator 81 bends at the left side and has a planar part Q3. A medium separation region α3 is located in the right side of the planar part Q3. The medium separation region α3 has the chamfered parts C3 and C4, and a tip part P3. The chamfered part C3 is inclined with a distance of ΔC3 in a thickness direction of the planar part Q3. The chamfered part C4 that is formed at the back side of the chamfered part C3 is also inclined with a distance of ΔC4 in the thickness direction of the planar part Q3. The tip part P3 is formed by the chamfered parts C3 and C4.

A surface of the separator 81 is coated by polytetrafluoroethylene (PTFE) to prevent developer from adhering. The separator 81 is located close to the pressure application roller 66 with a gap distance Δα3 at the location of the chamfered part C3, or a border part F3 between the chamfered part C3 and the planar part Q3.

Operation of Third Embodiment

When a power source is applied to the image forming device 10B, the fuser device 60A according to the third embodiment is ready to perform good fusing so as to complete preparation in the same manner as the first and second embodiments. Then, fusing can be performed by the fuser device 60A; and image formation can be performed by the image forming device 10B.

An operation for carrying the print medium 100 through the fuser device 60A in the image forming device 10B of the third embodiment is the same as the first and second embodiments.

The print medium 100 is carried to the nipping region 67B for performing fusing. Because the separator 81 is close to the pressure application roller 66 with the gap distance Δα3 as shown in FIG. 24, the print medium 100 that is applied thermal compression at the nipping region 67B is separated from the pressure application roller 66 by the separator 81 and is ejected from the fuser device 60A along with the chamfered part C4.

A condition is considered that the image forming device 10B or the fuser device 60A receives an impact from the outside. For example, the impact might occur during their transportation or when they are dropped. When the separator 81 or the pressure application roller 66 is deformed or dislocated by flexure, and the separator 81 contacts the pressure application roller 66, the border part F3 or the chamfered part C3 that is formed on the separator 81 interferes with the pressure application roller 66. As a result, the pressure application roller 66 is not damaged, a good fusing can be performed even after the image forming device 10B or the fuser device 60A receives the impact or shock.

"ΔC3" of the third embodiment is similar to "ΔB" of the first embodiment. The gap distance "Δα3" of the third embodiment is similar to the gap distance "Δα" of the first embodiment.

Effects of Third Embodiment

The fuser device 60A and the image forming device 10B according to the third embodiment have effects (A)-(D) discussed below.

(A) Because the chamfered parts C3 and C4 are formed at the medium separation region α3 in the separator 81, the tip part P3 of the separator 81 does not cause damage to the pressure application roller 66 even after the image forming device 10B or the fuser device 60A receives an impact or shock from the outside. As a result, good fusing can be performed, and image quality is increased similar to the separator 71 disclosed in the second embodiment. Specifically, when the image forming device 10B or the fuser device 60A receives an impact or shock from the outside, there is a possibility that the separator 81 and the pressure application roller 66 are deformed or dislocated. However, since the chamfered parts C3 and C4 are formed at the medium separation region α3 in the separator 81, the tip part P3 of the separator 81 does not cause damage to the pressure application roller 66.

(B) Because the separator 81 has a simple shape where the two chamfered parts are formed, it can be manufactured with low cost in the same manner of the separator 71 as the second embodiment.

(C) During the image forming device's 10B start-up process, heating and calibration (adjusting location) for the separator 81 is not required in the same manner of the image forming devices 10 and 10A as the first and second embodiments so that a quick start-up process of the image forming device 10B is realized.

(D) Because the separator 81 is located close to the pressure application roller 66, it is possible to prevent the print medium 100 from wrapping or adhering around the pressure application roller 66.

Fourth Embodiment

Configuration of Fourth Embodiment

Figure 26:
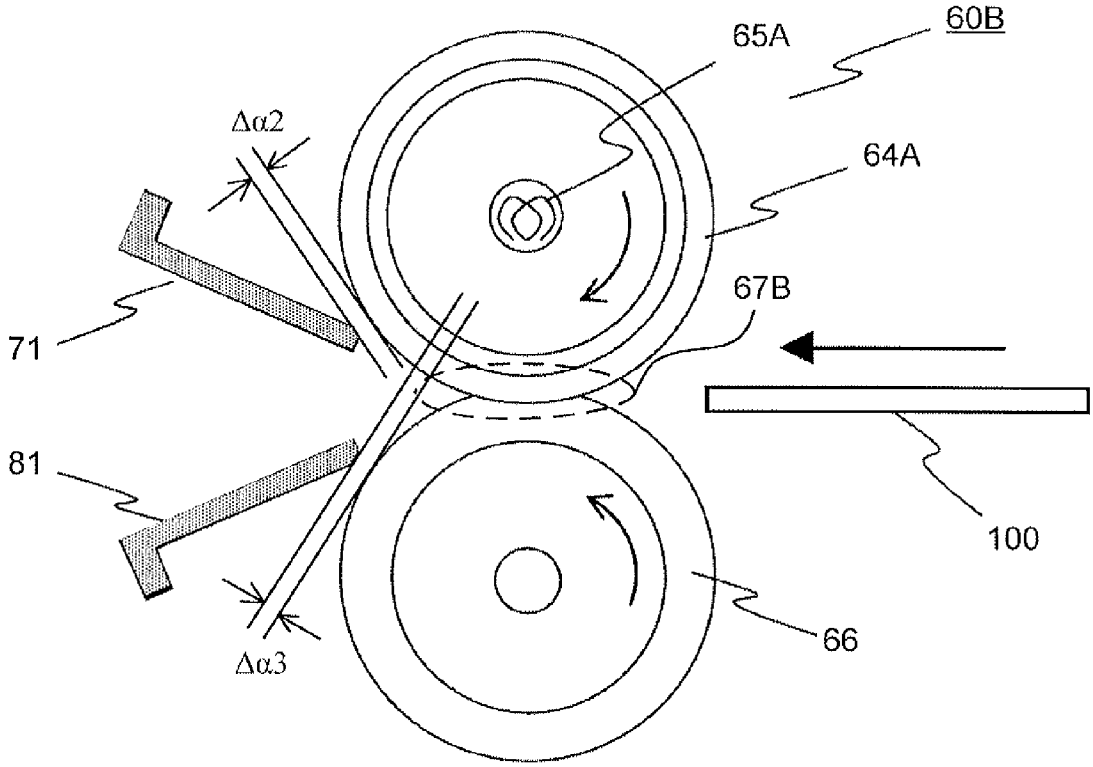
FIG. 26 is a schematic view of the fuser device of a fourth embodiment.

FIG. 26 is a schematic view of a fuser device of a fourth embodiment according to the present invention. Elements shown in FIG. 26 that are the same as elements shown in FIG. 24 of the third embodiment have the common reference numerals.

A fuser device 60B of the fourth embodiment is provided at an image forming device 10C in the same manner as the third embodiment. The fuser device 60B includes the pressure application roller 66 that presses the fuser roller 64A in the same manner as the third embodiment, the fuser roller 64 in the hollow circular cylindrical shape, and the separator 81 as a separation member (not shown) that separates the print medium 100 from the pressure application roller 66. The fuser device 60B further includes the separator 71 as a separation member (not shown) in the same manner as the second embodiment that separates the print medium 100 from the fuser roller 64A.

A halogen lamp 65A as a heating member is provided inside the hollow circular cylinder of the fuser roller 64A in the same manner as the third embodiment. Both end parts of the halogen lamp 65A are supported by support mediums (not shown). Both end parts of the fuser roller 64A and the pressure application roller 66 are supported by rotatable bearings (not shown), respectively.

A nipping region 67B that is to fuse a non-fused toner image on the print medium 100 is provided by biasing and contacting the pressure application roller 66 through a biasing member (not shown) to the fuser roller 64A in the same manner as the third embodiment.

A tip of the separator 71 in a plate-like shape is located close to the fuser roller 64A with a gap distance Δα2. A tip of the separator 81 in a plate-like shape is located close to the pressure application roller 66 with a gap distance Δα3 in the same manner as the third embodiment.

Operation of Fourth Embodiment

When a power source is applied to the image forming device 10C, the fuser device 60B according to the fourth embodiment is ready to perform good fusing so as to complete preparation in the same manner as the first through third embodiments. Then, fusing can be performed by the fuser device 60B; and an image forming can be performed by the image forming device 10C.

An operation for carrying the print medium 100 through the fuser device 60B in the image forming device 10C of the fourth embodiment is the same as the first through third embodiments.

The print medium 100 is carried to the nipping region 67B for performing fusing. The print medium 100 to which thermal compression is applied at the nipping region 67B is separated from the fuser roller 64A by the separator 71, or is separated from the pressure application roller 66 by the separator 81, and is ejected from the fuser device 60B.

A condition is considered where the image forming device 10C or the fuser device 60B receives an impact or shock from outside. There are the following possibilities: when the separator 71 or the fuser roller 64A is deformed or dislocated by flexure, and the separator 71 contacts the fuser roller 64A, the border part F2 or the chamfered part C1 that is formed on the separator 71 interferes with the fuser roller 64A. When the separator 81 contacts the pressure application roller 66, and the border part F3 or the chamfered part C3 that is formed on the separator 81 interferes with the pressure application roller 66. As a result, since the fuser roller 64A and the pressure application roller 66 are not damaged, good fusing can be performed even after the image forming device 10B or the fuser device 60A receives the impact or shock.

Effects of Fourth Embodiment

The fuser device 60B and the image forming device 10C according to the fourth embodiment have an effect (E) discussed below in addition to the effects (A)-(D) of the third embodiment discussed above.

(E) Because the separator 71 is located close to the fuser roller 64A; and the separator 81 is located close to the pressure application roller 66, it is possible to prevent the print medium 100 from wrapping or adhering around the fuser roller 64A and the pressure application roller 66.

Other Embodiments

The present invention is not limited to the embodiments discussed above and can be used for other applications and variations. Examples for other applications and variations are the following (a)-(e).

(a) The image forming devices 10, 10A, 10B and 10C of the first through fourth embodiments, respectively, may be a photocopy machine, a printer, a multifunction machine, a facsimile machine, and so on.

(b) The image forming devices 10, 10A, 10B and 10C of the first through fourth embodiments, respectively, form a color image. However, they are not limited to this and may form a single color image, such as a black-and-white color image.

(c) The fuser devices 40, 60, 60A and 60B of the first through fourth embodiments, respectively, use sheet-metal for the separators 51, 71 and 81. However, they are not limited to this and may use a molded material, a casting good, ceramic, or heat-resistance plastic.

(d) The fuser devices 40, 60, 60A and 60B of the first through fourth embodiments, respectively, use the separators 51, 71 and 81 on which a material that prevent developer from adhering is coated. However, that material is not limited to this and may use an easy-release sheet or tape that adheres to the surface of the separators 51, 71 and 81.

(e) The fuser devices 60, 60A and 60B of the second through fourth embodiments, respectively, has the chamfered parts at the tip of the separators 71 and 81. However, these parts are not limited to such shapes and may be in a chamfered shape, a tapered shape, or a curved shape. The fuser device and the image forming device being thus described, it will be apparent that the same may be varied in many ways. Such variations are not to be regarded as a departure from the sprit and scope of the invention, and all such modifications as would be apparent to one of ordinary skill in the art are intended to be included within the scope of the following claims.

What is claimed is:

1. A fuser device, comprising:
a fuser member that heats developer on a print medium;
a pressure member that presses the fuser member so as to provide a contact region therebetween; and
a separation member that separates the print medium, which is ejected from the contact region, from one of the fuser member and the pressure member, wherein
the separation member includes a separator in a plate-like shape and a support member that supports the separator such that the separator is disposed in the vicinity of the fuser member, and
the separator includes
a planar part in a plate-like shape that is sustained by the support member,
a tip part that is a tip of the separator,
an inclined surface part that is inclined toward the tip part in a thickness direction of the separator, a width of the inclined surface part being in a range of 0.5 mm-2.0 mm, and
a border part that is defined as a boundary between the planar part and the inclined surface part.

2. The fuser device according to claim 1, wherein
the separator is arranged adjacent to the one of the fuser member and the pressure member so as to become gradually closer to the one of the fuser member and the pressure member in a direction from a held part supported by the support member toward the border part, and so as to become gradually more distant from the one of the fuser member and the pressure member in a direction from the border part toward the tip part.

3. The fuser device according to claim 1, wherein
the separator is arranged such that a first gap distance between the tip part and the one of the fuser member and the pressure member is equal to or more than a second gap distance between the border part and the one of the fuser member and the pressure member.

4. The fuser device according to claim 3, wherein
the separator further includes spacer members contacting the one of the fuser member and the pressure member, and the spacer members are provided at both ends of the separator in a longitudinal direction so as to maintain the second gap distance.

5. The fuser device according to claim 1, wherein a width of the inclined surface part is in a range of 0.8 mm-1.2 mm.

6. The fuser device according to claim 1, wherein
the separator further includes:
a bent part that is disposed at an opposite side of the tip part, the bent part being formed by bending the planar part, and extending over the separator in a longitudinal direction, and
held parts that are disposed in the vicinity of the bent part at both ends of the separator in a longitudinal direction, and that are substantially parallel to a short side direction of the separator, the held parts respectively including an aperture through which the support member is inserted.

7. An image forming device, comprising:
the fuser device according to claim 1.

8. A fuser device, comprising:
a fuser member that heats developer on a print medium;
a pressure member that presses the fuser member so as to provide a contact region therebetween; and
a separation member that separates the print medium, which is ejected from the contact region, from one of the fuser member and the pressure member, wherein
the separation member includes a separator in a plate-like shape and a support member that supports the separator such that the separator is disposed in the vicinity of the fuser member, and
the separator includes
a planar part in a plate-like shape that is sustained by the support member,
a tip part that is a tip of the separator,
an inclined surface part that is inclined toward the tip part in a thickness direction of the separator, and
a border part that is defined as a boundary between the planar part and the inclined surface part,
wherein a first gap distance between the tip part and the one of the fuser member and the pressure member is in a range of 0.3 mm-1.15 mm, and
a second gap distance between the border part and the one of the fuser member and the pressure member is in a range of 0.3 mm-1.0 mm.

9. The fuser device according to claim 8, wherein
the first gap distance is in a range of 0.4 mm-0.75 mm, and
the second gap distance is in a range of 0.4 mm-0.6 mm.

10. The fuser device according to claim 8, wherein
the first gap distance is in a range of 0.6 mm-0.75 mm, and
the second gap distance is in a range of 0.4 mm-0.6 mm.

11. The fuser device according to claim 8, wherein
the separator further includes spacer members contacting the one of the fuser member and the pressure member, and the spacer members are provided at both ends of the separator in a longitudinal direction so as to maintain the second gap distance.

12. The fuser device according to claim 8, wherein the separator further includes:

a bent part that is disposed at an opposite side of the tip part, the bent part being formed by bending the planar part, and extending over the separator in a longitudinal direction, and held parts that are disposed in the vicinity of the bent part at both ends of the separator in a longitudinal direction, and that are substantially parallel to a short side direction of the separator, the held parts respectively including an aperture through which the support member is inserted.

13. An image forming device, comprising:

the fuser device according to claim 8.

14. A fuser device, comprising:

a fuser member that heats developer on a print medium;

a pressure member that presses the fuser member so as to provide a contact region therebetween; and a separation member that separates the print medium, which is ejected from the contact region, from one of the fuser member and the pressure member, wherein the separation member includes a separator in a plate-like shape and a support member that supports the separator such that the separator is disposed in the vicinity of the fuser member, and the separator includes a planar part in a plate-like shape that is sustained by the support member, a tip part that is a tip of the separator, an inclined surface part that is inclined toward the tip part in a thickness direction of the separator, and a border part that is defined as a boundary between the planar part and the inclined surface part, wherein a gap distance between the border part and the one of the fuser member and the pressure member is in a range of 0.3 mm-1.0 mm, a first angle, which is defined between the inclined surface part and a line that passes through the border part, and that is perpendicular to one of a surface of the fuser member and a surface of the pressure member, is in a range of 88.2°-107.2°, and a second angle, which is defined between the planar part and the line, is equal to or larger than 90°.

15. The fuser device according to claim 14, wherein the gap distance is in a range of 0.4 mm-0.6 mm.

16. The fuser device according to claim 14, wherein the separator further includes spacer members contacting the one of the fuser member and the pressure member, and the spacer members are provided at both ends of the separator in a longitudinal direction so as to maintain the gap distance.

17. The fuser device according to claim 14, wherein the separator further includes:

a bent part that is disposed at an opposite side of the tip part, the bent part being formed by bending the planar part, and extending over the separator in a longitudinal direction, and held parts that are disposed in the vicinity of the bent part at both ends of the separator in a longitudinal direction, and that are substantially parallel to a short side direction of the separator, the held parts respectively including an aperture through which the support member is inserted.

18. An image forming device, comprising:

the fuser device according to claim 14.

* * * * *